US010726678B1

(12) United States Patent
Rehill et al.

(10) Patent No.: US 10,726,678 B1
(45) Date of Patent: Jul. 28, 2020

(54) SYSTEMS AND METHODS FOR GENERATING AND OUTPUTTING DATA TO MODIFY A GRAPHICAL USER INTERFACE OF AN ONLINE ROULETTE GAME

(71) Applicant: Roxor Gaming Limited, London (GB)

(72) Inventors: Jagbir Rehill, London (GB); Thomas David James Aicken, London (GB); Hans Elias, Hertfordshire (GB); Alexander Sandford Todd Young, London (GB)

(73) Assignee: Roxor Gaming, Ltd., London (GB)

( * ) Notice: Subject to any disclaimer, the term of this patent is extended or adjusted under 35 U.S.C. 154(b) by 0 days.

(21) Appl. No.: 15/090,562

(22) Filed: Apr. 4, 2016

Related U.S. Application Data

(60) Provisional application No. 62/141,925, filed on Apr. 2, 2015.

(51) Int. Cl.
*G07F 17/32* (2006.01)

(52) U.S. Cl.
CPC ..... *G07F 17/329* (2013.01); *G07F 17/326* (2013.01); *G07F 17/3225* (2013.01)

(58) Field of Classification Search
CPC ... G07F 17/329; G07F 17/3225; G07F 17/326
USPC ..... 463/17
See application file for complete search history.

(56) References Cited

U.S. PATENT DOCUMENTS 6,572,474 B2 6/2003 Rudd
8,308,547 B2 11/2012 Walker et al.
10,475,277 B2 11/2019 Reeves
2004/0023712 A1* 2/2004 Oliver ..... G07F 17/32 463/18
2004/0166918 A1 8/2004 Walker
(Continued)

FOREIGN PATENT DOCUMENTS

WO WO2007077449 7/2007

OTHER PUBLICATIONS

Website: "PlayRoulette Online" (http://playrouletteonline.co/multiwheel-roulette/) download date: Nov. 23, 2015; 2 pps.
(Continued)

*Primary Examiner* — Jay Trent Liddle
*Assistant Examiner* — Ryan Hsu
(74) *Attorney, Agent, or Firm* — Fincham Downs LLC; Magdalena M. Fincham

(57) ABSTRACT

In accordance with some embodiments, an online roulette game provides an opportunity to place a multi-spin wager, wherein a win condition of the multi-spin wager requires the player to obtain, over a plurality of consecutive spins of the roulette wheel, a predetermined number of unique outcomes and wherein each unique outcome is independently determined such that it is not dependent on any previously determined outcome obtained for the multi-spin wager. For example, the multi-spin wager may be that the next 7 outcomes will each be from different "streets" or columns in a grid of available numbers corresponding to numbers on the roulette wheel or that the next 23 numbers the ball lands on will each be different from one another. In some embodiments such a multi-spin wager may be embodied as a side bet and/or a bet that is made available for joining by a plurality of players.

20 Claims, 9 Drawing Sheets

(56) References Cited

U.S. PATENT DOCUMENTS

| | | | | |
|---|---|---|---|---|
| 2004/0192432 | A1 | 9/2004 | Walker | |
| 2004/0192434 | A1 | 9/2004 | Walker | |
| 2005/0212210 | A1* | 9/2005 | Ogiwara | G07F 17/32 273/274 |
| 2005/0285336 | A1* | 12/2005 | Ilievski | A63F 5/00 273/143 R |
| 2006/0052149 | A1* | 3/2006 | Bursill | G06Q 50/34 463/16 |
| 2006/0168107 | A1* | 7/2006 | Balan | G06F 9/505 709/218 |
| 2007/0135204 | A1* | 6/2007 | Nicely | G07F 17/32 463/17 |
| 2010/0009744 | A1* | 1/2010 | Mugnolo | G07F 17/32 463/27 |
| 2011/0092270 | A1 | 4/2011 | Jarvis et al. | |

OTHER PUBLICATIONS

Website: "Roulette Strategy" (http://www.roulettestrategy.net/bets/) download date: Nov. 23, 2015; 3 pps.

Website: "Roulette Scripter Studio" (http://www.slideshare.net/roulettesystem/roulette-scripter-studio-the-most-advanced-auto-play-roulette-tool) download date: Nov. 23, 2015; 9 pps.

Office Action for U.S. Appl. No. 14/838,917 dated Feb. 9, 2018; 12 pps.

Notice of Allowance for U.S. Appl. No. 14/838,917 dated Feb. 8, 2019; 5 pps.

Notice of Allowance for U.S. Appl. No. 14/838,917 dated Jul. 12, 2019; 5 pps.

* cited by examiner

SYSTEMS AND METHODS FOR GENERATING AND OUTPUTTING DATA TO MODIFY A GRAPHICAL USER INTERFACE OF AN ONLINE ROULETTE GAME

CLAIM OF PRIORITY

The present application claims the benefit of priority of U.S. Provisional Application No. 62/141,925 filed Apr. 2, 2015 in the name of Rehill et al., titled SYSTEMS AND METHODS FOR A ROULETTE GAME. The entirety of this provisional application is incorporated by reference herein for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

DETAILED DESCRIPTION

Figure 1:
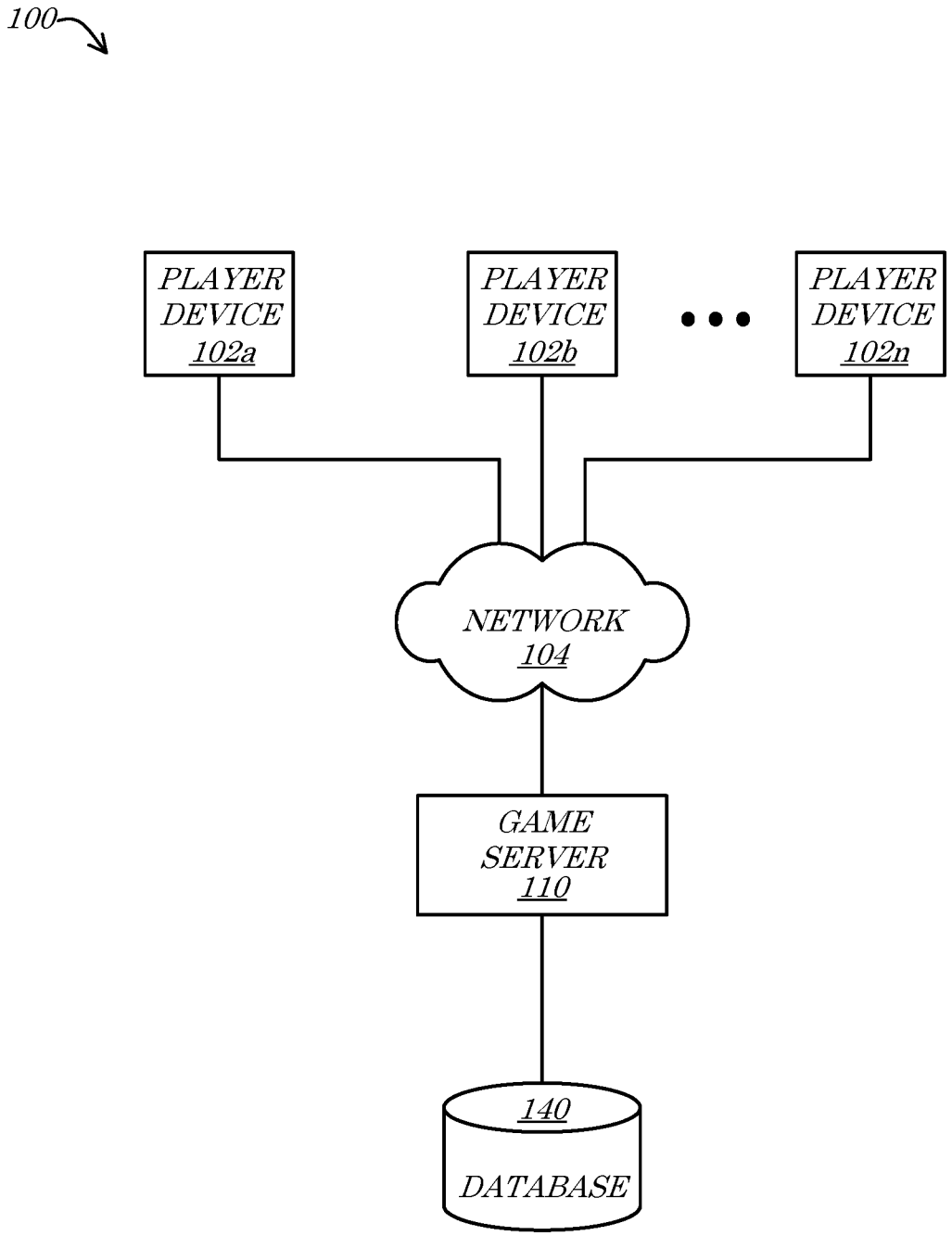
FIG. 1 is a schematic diagram of an embodiment of a gaming system in accordance with one or more embodiments described herein.

Described herein are various embodiments of an inventive roulette game (e.g., a virtual roulette game, such as may be played online via a player device) which provides for allowing a player to bet on a result which depends on at least two spins (e.g., two consecutive spins) of a roulette wheel, such that whether the bet is a winning bet or losing bet cannot be determined until the outcome of each of the spins is determined. For example, player may be provided an opportunity to place a wager on the result of the next two (2) consecutive roulette spins as a fixed odds bet prior to the outcome of the first spin of the two (2) spins being output or, in some embodiments, even determined. In such a wager, whether the player wins the wager at all (and not just an amount of payout or win for the bet) depends on the outcomes of both spins. For example, the player may be allowed to place a bet that the next two spins will result in the ball landing on a different color for the respective spins (i.e., the ball will land on red for one spin and on black for the other spin) and the determination of whether the player has won the bet will be made once the outcome of both spins corresponding to the player's bet have been determined. In other words, in accordance with some embodiments, the determination of whether a bet is a winning bet (such that a payout is provided to the player) or a losing bet (such that the player loses the amount of value placed on the bet and does not receive a payout) is dependent two or more outcomes, each outcome corresponding to a respective spin of the roulette wheel (or, in some embodiments, each outcome corresponding to a respective ball being spun, even if the two or more balls are spun simultaneously). Whether a bet is a winning bet or a losing bet is referred to herein as a win result and the determination of whether a bet is a winning bet or a losing bet is referred to herein as a win result determination.

In some embodiments, a win result of a bet encompassing two or more outcomes (e.g., two or more outcomes of distinct spins of a roulette wheel) is further dependent on whether one outcome of the two or more outcomes encompassed by the bet bears a pre-determined relationship to at least one other outcome of the two or more outcomes encompassed by the bet. For example, the player may bet that a number comprising the outcome of the second spin will be a higher number than a number comprising the outcome of the first spin. In a conventional roulette game, a determination of whether a bet on a spin of a roulette wheel is a winning bet or a losing bet is in actuality independent of a result of any previous spin (despite certain strategies and theories some players employ, which attempt to predict an outcome of an upcoming roulette spin based on outcomes of previous roulette spin(s)).

In accordance with some embodiments, a player of a roulette game (e.g., an electronic roulette game such as a roulette game playable online) may indicate placement of a bet the result of which depends on a plurality of independent outcomes of the roulette game. The indication of the bet may define one or more win conditions for the bet. For example, the win conditions may comprise at least one of the following data that defines a bet or wager: (i) a number of consecutive outcomes (the number being greater than one (1)) to be evaluated in order to determine the result of the bet; (ii) a period of time during which outcomes are to be evaluated in order to determine the result of the bet; and (iii) one or more parameters defining an outcome which disqualifies the player from winning the bet or which qualifies the player to remain eligible for winning the bet. A gaming system may thus be operable to receive such an indication of a bet, including the one more win conditions of the bet, determine the plurality of independent outcomes which are to be evaluated in order to determine a result of the bet and determine the result of the bet based on the one or more win conditions.

In accordance with some embodiments, a player may place a bet that a particular outcome will not be repeated within a predetermined number of spins of a roulette wheel or a within a predetermined period of time. In such a bet, the player would lose the bet if the particular outcome were to be repeated within the predetermined number of spins or period of time. The particular outcome may, in some embodiments, comprise a category of outcome or one or more parameters defining the outcome. For example, the player may bet that an outcome consisting of a number in a particular row (e.g., a "street") of the roulette felt layout will only occur once within the next twelve spins of the roulette wheel, such that the particular outcome comprises any number in that row. In one embodiment, the bet may comprise a bet that each of a plurality of particular outcomes will only occur once within the next predetermined number of spins or predetermined period of time. For example, a player may bet that the roulette ball will land on a number within each row of a plurality of rows (the particular rows may be defined by the bet) of a felt layout of the roulette game only once during the next twelve (12) spins of the roulette wheel. In another embodiment, the particular outcome may comprise the next subsequent outcome which occurs after the player places the bet. For example, the player may bet that, whatever number the ball of the roulette wheel lands upon the resolution of the next spin, it will not land on that same spot again within the next ten spins. FIGS. 4A-4E, described below, illustrate some examples of how bets that a particular outcome will not be repeated within a predetermined number of spins of a roulette wheel or a within a predetermined period of time may be implemented in accordance with some embodiments. It should be noted that when a roulette wheel "number" is referred to herein, such reference is not necessarily limited to a particular color of that number.

In accordance with some embodiments, methods, systems and articles of manufacture (e.g., non-transitory computer-readable media) provide for (i) receiving, from a player, an indication of a wager on a win result dependent on a plurality of outcomes to be determined over a course of a plurality of spins (e.g., of a single roulette wheel), each outcome of the plurality of outcomes corresponding to a respective one spin of the plurality of spins; (ii) determining (e.g., after the indication of the wager is received), for each spin of the plurality of spins, a respective outcome, thereby determining the plurality of outcomes; (iii) determining, based on each of the plurality of outcomes, whether the wager is a winning wager; and (iv) providing a payout to a player associated with the wager if the wager is a winning wager. In other words, in order for a player to win the wager, a plurality of spins of a roulette wheel are executed (e.g., a plurality of consecutive spins) and the outcomes of those spins need to satisfy the result the player has wagered will occur, such that the win result of the wager is dependent on the plurality of spins (e.g., plurality of consecutive spins) or the plurality of outcomes.

In accordance with some embodiments, methods, systems and articles of manufacture (e.g., non-transitory computer-readable media) provide an online roulette game to a plurality of remote user devices using (i) a processor of a game application delivery controller, wherein the game application delivery controller is in communication with a game server cluster; and (ii) a computer-readable memory in communication with the processor of the game application delivery controller, the computer-readable memory storing instructions that when executed by the processor of the game application delivery controller direct the processor to facilitate an online game of roulette. Facilitating the online game of roulette may comprise, in accordance with some embodiments, (i) enabling a player to participate in a roulette game using a user device; (iii) receiving, from the user device, a request for an online gaming interface for a roulette game; (iv) transmitting a request to a roulette game server of the game server cluster for the online gaming interface for the roulette game; (v) receiving data defining a series of consecutive outcomes for the roulette game, based on output from a random number generator (e.g., numbers and/or colors on which a virtual ball of a virtual roulette wheel "lands" on); (vi) generate the online gaming interface, wherein the generated online gaming interface comprises a representation of a roulette felt layout and a roulette wheel and an actuatable mechanism configured to allow a player to indicate a desired multi-spin wager; (vii) receive, via the actuatable mechanism, a selection of a particular multi-spin wager; (vii) enable, in the online gaming interface, a series of movements of the virtual roulette wheel, each respective movement indicating an outcome of the roulette game; and (viii) modify, after each movement of the roulette wheel, the online game interface to indicate one of (a) an indication that the multi-spin wager is still winnable and has not been lost as a result of the most recent outcome; and (b) an indication that the multi-spin wager has been lost as a result of the most recent outcome.

In accordance with some embodiments, facilitating the online roulette game may further comprise determining at least one parameter of the multi-spin wager. This may comprise, for example, determining at least one of a number of consecutive outcomes or a period of time during which a specified outcome cannot be repeated in order for the wager to be won. This may further comprise determining the specified outcome (e.g., a particular number, color, row within which the outcome appears in a roulette felt layout of the roulette game, etc.).

An "outcome" should be differentiated from a "result" in the present description in that an "outcome" is a representation of game indicia determined via a process or algorithm as the final output of a game event (e.g., a spin of a roulette wheel) which, after taking into account a player's bet option, amount bet and odds associated with the bet option, allows a determination of a "result" for the game event. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In another example, in a roulette game, an "outcome" of a spin of the game may comprise a "red 7" and the "result" corresponding to this outcome, based on a bet of a particular player who selected a bet option that the outcome would include a "red" game indicia, is that the player wins the bet and is provided a payout based on the amount of the bet and the odds associated with the bet. It should be noted that the embodiments described herein encompass prizes which may comprise awards, payouts, discounts, eligibility, advancement in a game or other benefits (whether monetary or non-monetary, tangible or intangible) to a player and that any reference to a "prize", "award" or "payout" may refer to any or all of the foregoing, unless the context explicitly indicates otherwise.

A brief overview of roulette games is provided herein, along with a discussion of relevant terminology. It should be understood that features such as a "roulette wheel" and "balls" need not be conventional physical elements. Simulated or virtual wheels and balls are also to be included in the embodiments described herein. Thus, the generic term used herein is "roulette wheel" or ball, which may refer to either "physical" or "virtual" renditions of the wheel or ball. In a virtual roulette table (e.g., in a roulette game embodied as an online or other electronic or software-based game) the physical wheel is replaced with a virtual wheel whose image is provided on a display.

The term "roulette wheel" may refer to an American or European (both explained below) roulette wheel or another non-traditional type of roulette wheel; the embodiments described herein are not dependent on any particular rendition or configuration of a roulette wheel. For example, the numbers and/or colors on the wheel could be arranged in any desirable manner; more or fewer numbers than traditional could be included, and/or the numbers could be replaced by symbols (e.g., fruit). Similarly, "spinning" of a wheel can cover any arrangement (e.g., a graphical animation) where a number on a roulette wheel is selected in what appears to be (or actually is) a random (or pseudo-random, based on a pseudo-random algorithm) manner.

In a typical roulette game, players place bets by positioning their chips relative to one or more indicia (e.g., at least one number and/or color of the roulette wheel) such that a bet option is selected. The roulette wheel then spins and a ball is introduced onto the wheel. The ball moves around the wheel in a direction opposite the rotation of the wheel and slows until it falls into a labeled area of the wheel (e.g., into an area labeled or associated with a particular color, number and/or other indicia). If the bet option a player had selected is satisfied by the area of the wheel in which the ball stops, the player wins the bet and is provided with a payout (e.g., the payout amount dependent on the bet amount and the odds of the bet option). Otherwise, the player is considered to have lost the bet and the chips or credits the player bet on the spin are collected from the player. In a multi-wheel roulette game, multiple roulette wheels may be spun simultaneously and the player may place a bet on one or more of the wheels (selecting the same bet option for each wheel or different bet options for different wheels, depending on the rules of the game). Irrespective of whether the game includes a single wheel or multiple wheels, the outcome of each spin of a given wheel is independent of any previous outcomes and is independent of the outcomes on the other wheels. Similarly, the result of each bet option selected by the player is dependent only on the outcome of the single spin on which the bet option is placed. Some roulette games have a historical outcomes display that lists outcomes from previous spins. For example, outcomes for the last ten spins may be displayed. While the outcome of each spin is independent of every other spin (and the result of each bet option is independent of the result of any previous bet option), some players may use this historical outcome listing to assist them in guessing which numbers are "due" or which numbers are "hot" or to otherwise try to predict subsequent outcomes when placing a bet.

As briefly mentioned above, there are two generally recognized styles of roulette wheels, namely U.S. and European. The difference between the two styles is that the U.S. style roulette wheel includes the numbers zero through thirty-six and a double zero. In contrast, the European style roulette wheel includes just numbers zero through thirty-six. Additionally, the number placement on the wheel differs between the U.S. style and the European style, such that while some numbers may be next to each other on a U.S. wheel, the numbers may not be next to each other on a European wheel.

Conventional betting options typically presented on a roulette table include the numbers individually (a straight or straight up bet), even, odd, red, black, low (numbers one through eighteen), high (numbers nineteen through thirty-six), first twelve (numbers one through twelve), second twelve (numbers thirteen through twenty-four), third twelve (numbers twenty-five through thirty-six), first column (numbers one, four, seven, ten, thirteen, sixteen, nineteen, twenty-two, twenty-five, twenty-eight, thirty-one, and thirty-four), second column (numbers two, five, eight, eleven, fourteen, seventeen, twenty, twenty-three, twenty-six, twenty-nine, thirty-two, and thirty-five), and third column (numbers three, six, nine, twelve, fifteen, eighteen, twenty-one, twenty-four, twenty-seven, thirty, thirty-three, and thirty-six). Each of these bet options is typically represented via indicia on the table.

There are other conventional wagers that do not have specific indicia, but whose import is known to roulette players. For example, a split bet is a wager on two numbers that appear next to one another. A player selecting this bet option may indicate this by placing a chip on the line between the two bet options (e.g., the line between one and four or twenty-nine and thirty) or by selecting a corresponding area of an interface in a virtual (e.g., online) roulette game. In another example, a street bet (sometimes called a row bet) is a wager on three numbers on the same row. A player selecting this bet option may indicate this by placing a chip outside the row of numbers on which he is wagering (e.g., to wager on one-two-three, the chip is placed on the line that is the outside edge of the three) or by selecting a corresponding area of an interface in a virtual (e.g., online) roulette game. In yet another example, a corner bet is a wager on four adjoining numbers. A player selecting this bet option may indicate this by placing a chip at the four-way intersection of the four numbers (e.g., at the intersection of thirty-one, thirty-two, thirty-four, and thirty-five) or by selecting a corresponding area of an interface in a virtual (e.g., online) roulette game. In yet another example, a square bet is a wager on zero, one, two, or three and is denoted by placing the chip at the intersection of zero and three at the corner of a European style wheel. A five number bet is similar to the square bet, but adds the double zero. A player selecting this bet option may indicate this by placing a chip at the intersection of zero and one, on the corner, or by selecting a corresponding area of an interface in a virtual (e.g., online) roulette game. A line bet is in essence wagering on two streets or rows. A player selecting this bet option may indicate this by placing a chip on the outer intersection of the two rows in question (e.g., to bet on seven through twelve, a chip would be placed at the outer intersection of nine and twelve) or by selecting a corresponding area of an interface in a virtual (e.g., online) roulette game. A summary of some conventional wagers and the odds are presented below in table 1.

TABLE 1

| Wager Name | Numbers Covered | Odds |
|---|---|---|
| Straight Up Bet | 1 | 35:1 |
| Split Bet | 2 | 17:1 |
| Street (row) Bet | 3 | 11:1 |
| Corner Bet | 4 | 8:1 |
| Square Bet | 4 (0, 1, 2, 3) | 8:1 |
| Five Number Bet | 5 (0, 00, 1, 2, 3) | 6:1 |
| Line Bet | 6 | 5:1 |
| Dozens | 12 | 2:1 |
| Columns | 12 | 2:1 |
| Low/High | 18 | 1:1 |
| Odd/Even | 18 | 1:1 |
| Red/Black | 18 | 1:1 |

In accordance with embodiments described herein, a player is provided an opportunity to place a new type of bet which is a bet on a plurality of game events (e.g., a plurality of spins of a roulette wheel or a plurality of ball outcomes for multiple balls on a single spin), wherein the win result of the bet (i.e., a determination of whether the bet is a winning bet or a losing bet) is dependent on the result of a set or plurality of outcomes defined by the bet (e.g., a set or plurality of spins of a roulette wheel, such as the next two or more spins of the roulette wheel). In accordance with some embodiments, the player is required to place the bet without any knowledge of the outcome of the first game event, such as the outcome of the first spin of a roulette wheel. For example, the player may be required to place the bet prior to the outcome of the first game event being determined (e.g., by an algorithm employing a Random Number Generator (RNG)) or prior to the outcome for the first game event being output to the player (such that in some embodiments at least the first outcome of the set of outcomes may have been determined by the time the player places his/her bet, but the at least first outcome has not yet been output or indicated to the player). Whether the player wins the bet is thus dependent on each of the set of outcomes included in the set of outcomes corresponding to the bet (e.g., the outcomes of the next two spins of the roulette wheel if the player places a bet indicating what he/she is betting will happen over the course of the next two spins in terms of the outcomes determined). Some non-limiting examples of bets defining a win result of a plurality of roulette spins are provided herein.

Different Colors:

In this type of bet, the player is allowed an opportunity to place a bet on how a characteristic of one outcome compares to the same characteristic of another outcome. In one embodiment, the characteristic is a color or other game indicia of the outcome. In one embodiment, the player is provided an opportunity to bet whether two or more outcomes will share a characteristic (e.g., will be the same color). For example, the player may bet that, for the next two spins of the roulette wheel, the outcome of each spin will be a different color from the other. For example, if the outcome of one spin is "red" (the ball lands on a red area of the wheel) and the outcome of the other spin is "black" (the ball lands on black), then the player wins. If both spins result in the same color (the ball lands on the same color for each spin), the bet is a losing bet and the player loses his wager amount. In one embodiment, the ball or roulette wheel is spun twice (or, in some embodiments, two roulette wheels are spun either in series or simultaneously) to determine the win result of this bet. The sequence of outcomes may be irrelevant in some embodiments of this bet (i.e., it may be irrelevant whether the first outcome is red and the second outcome is black of vice versa) while in other embodiments the player may further narrow his bet by indicating a sequence in which the different colors or outcomes will occur (e.g., player bets that the first outcome will be red and the second will be black), which may result in longer odds and a higher payout for the player if the player wins such a bet. In some embodiments, such a "different color" bet may be placed on a single spin in which two balls are spun but the win result of the bet is still dependent on the outcome of each ball (what color each ball lands on), such that the win result of the bet is dependent on a plurality of outcomes. Of course, the two spins or two balls used in this example are for illustrative purposes only and any number of spins or balls may be used (e.g., the player may bet that of the next ten spins, the ball will land on "red" in at least four of the spins such that the win result of the bet will be determined once the outcomes for each of the ten spins encompassed by the bet are determined).

The odds for a "Different Colors" type of multi-spin wager may be determined in a variety of manners. In one example embodiment, assuming the wager pays even money, the odds for a "Different Colors" type of multi-spin water may be as follows:

(i) Assuming that landing on zero on your first spin results in a losing bet:

probability that the ball lands on a red or black on the first spin=36/37 probability that the ball lands on the opposite colour on the second spin=18/37

Total probability=(36/37)*(18/37)=0.473338

(ii) Assuming that landing on zero on your first spin results in a re-spin probability that the ball lands on a red or black on the first spin=1 probability that the ball lands on the opposite colour on the second spin=18/37

Total probability=1*(18/37)=18/37

Hi-Lo:

In this type of bet, the player bets on how a first outcome will relate in some predetermined manner to another outcome (similar to the "Different Colors" type of bet described above but focusing on a different characteristic, such as a number indicia). For example, the player may be whether a number comprising a first outcome will be lower or higher than a number comprising a second outcome. If the player bets on "Hi", he is betting that, for the next two spins of the roulette wheel, the outcome of the first spin (the number the ball lands on for the first spin) will be higher than the outcome determined for the second spin (the number the ball lands on for the second spin). For example, if the outcome of the first spin is "10" (the ball lands on the number "10" of the wheel) and the outcome of the second spin is "7" (the ball lands on the number "7" of the wheel), then the player wins the bet. If, on the other hand, the outcome of the second spin is a number higher than the "10" outcome of the first spin, the bet is a losing bet and the player loses his wager amount. Similarly, if the player places a bet on "Low", he is betting that the outcome of the first spin will be a number that is lower than the number which is the outcome for the second spin.

The odds for a "Hi-Lo" type of multi-spin wager may be determined in a variety of manners. In one example embodiment, assuming the wager pays even money, the odds for a "Hi-Lo" type of multi-spin water may be 18/37.

Over—Under:

In this bet the player is betting that when the outcomes of two or more spins are combined together in accordance with some predetermined manner (e.g., the number comprising the respective outcomes are added together), the result will be within some predetermined category of results (e.g., the sum of the numbers will be higher than a predetermined number or lower than a predetermined number). Of course, other mathematical relationships or manners of combining outcomes may be utilized (e.g., the numbers may be averaged, subtracted, used as values in some other formula, etc.). The ball or roulette wheel is spun the appropriate number of times (or, in some embodiments, multiple roulette wheels are spun either in series or simultaneously) to obtain the appropriate number of outcomes to be combined in order to determine the win result of the bet. For example, the player may bet that the sum of numbers of the next two spins will be under 36, in which case a roulette wheel may be spun twice and the respective numbers on which the ball lands may be added to determine the sum. If the sum of the numbers is less than 36, the win result of the bet is that the player wins the bet. If the sum of the numbers is 36 or greater, the player loses the bet. Similarly, the player may be that the sum of number comprising the plurality of outcomes encompassed by the bet will be over (or equal to) a predetermined number. In some embodiments, the player may also be allowed to select the predetermined number while in other embodiments the predetermined number is preset or selected by a processor (e.g., randomly selected by the processor).

The odds for an "Over-Under" type of multi-spin wager may be determined in a variety of manners. In one example embodiment, assuming the wager pays even money, the odds for an "Over-Under" type of multi-spin water may be (assuming the wager has been set to be over 36 or under 36) 18/37.

"Streets of Gold"—

In this bet, a player is betting that the outcomes of the next predetermined number (e.g., 12) of spins will be numbers that are all on unique streets to each other. The bet is ended once the ball lands on a number which is on a street which the ball has already landed on in a previous spin which is within the series of spins being evaluated for the win result of the bet (e.g., if the ball lands on Red 3 for a current spin but the ball has previously landed on Black 2 during the series of spins that are part of the player's bet, and Red 3 is in the same row on the felt layout of the game as Black 2, then the player loses the bet). In accordance with some embodiments, if the ball lands on Zero that spin is not counted towards the win result determination for the bet. In accordance with some embodiments, this type of bet (as well as other types of new bets described herein, the result of which is dependent on a plurality of independently determined outcomes) be may be made available as a side bet (although it can alternately be offered as a primary betting mechanism). In accordance with some embodiments, such a side bet may only be activated or made available for players to join or wager on at specific times. In one embodiment, such side bets may be implemented as "community bets" such that every player who has joined the side bet wins together (e.g., at the same time, based on the same series of outcomes, based on the same odds and/or by sharing a progressive jackpot amount).

The odds for a "Streets of Gold" type of multi-spin wager may be determined in a variety of manners. In one example embodiment, assuming the wager pays even money, the odds for a "Streets of Gold" type of multi-spin water may be as follows:

- $1^{st}$ Spin: Probability that the ball lands on 1st street is 36/37. Landing on Zero (probability is 1/37) results in a re-spin.
- $2^{nd}$ Spin (after $1^{st}$ spin results in $1^{st}$ street): Probability that ball lands on a $2^{nd}$ street is 33/37, with a 1/37 chance of a re-spin.
- Continuing the logic for subsequent spins of the virtual roulette wheel (or subsequent outcomes for the current series of outcomes), such that for nth Spin or nth outcome in the series (assuming wager hasn't been lost due to a repeated street), the probability that the ball lands successfully on a $n^{th}$ street is (39−3n)/37, with a 1/37 chance of a re-spin.

"Number Run"—

In one embodiments the "streets" or rows of numbers defining the win conditions of the bet (such as described with respect to the Streets of Gold bet) may instead be individual numbers. For example, the player may bet that the ball will not land on the same number more than once during the next ten spins, and may or may not be required to specify which number (s)he is betting on will not be repeated. In one embodiment, a progressive payout feature may be implemented, such that an amount of payout for the bet increases as the number of unique numbers/outcomes in the series of outcomes or spins comprising the bet increases (e.g., the payout may be won if X unique numbers land before a number is repeated). A bet in which the player is betting that a number will not be repeated in consecutive spins (i.e., the same number will not be an outcome for more than one spin within a consecutive series of spins) a type of bet may be referred to as a "Number Run" bet or side bet. In some Number Run bets, the payout for the bet may be increased as the number of consecutive spins without a repeating number outcome increases.

The odds for a "Number Run" type of multi-spin wager may be determined in a variety of manners. In one example embodiment, assuming the wager pays even money, the odds for a "Number Run" type of multi-spin water may be as follows:

- Player's first roll is always successful, giving him/her a Run of 1 number;
- If player's Run includes the Zero:
  - Player has a 36/37 chance of increasing the Run to 2 numbers, 1/37 chance of no improvement, and 0 chance of losing the bet.
- If player's Run does not include the Zero:
  - Player has a 36/37 chance of increasing the Run to 2 numbers, 0 chance of no improvement, 1/37 chance of losing;

Next, a second outcome for the current Run/sequence of outcomes is obtained and it is determined whether a Run of 2 numbers is obtained or the bet is lost.

- If, after the second outcome for the Run is obtained, the player's Run has 2 numbers:
  - If Run includes the Zero; player has a 35/37 chance of increasing the Run to 3 numbers, 1/37 chance of no improvement, and 1/37 chance of losing the bet (by obtaining a number/outcome that has already been obtained in the current Run).
  - If Run does not include the Zero: player has a 35/37 chance of increasing the Run to 3 numbers, 0 chance of no improvement and a 2/37 chance of losing the bet.

Next, a third outcome for the current Run/sequence of outcomes is obtained and it is determined whether a Run of 3 numbers is obtained or the bet is lost.

- For a Run of N numbers, the probabilities may be determined as follows:
  - If the Run includes the Zero: the player has a (37−N)/37 chance of increasing the Run to N+1 numbers, 1/37 chance of no improvement, and (N−1)/37 chance of losing the bet.
  - If the Run does not include the Zero: the player has a (37−N)/37 chance of increasing the Run to N+1 numbers, 0 chance of no improvement, N/37 chance of losing.

In one embodiment, a Number Run bet or another bet of the type described herein, the result of which is dependent on a plurality of consecutive, independently-determined outcomes, may be implemented as a progressive type of bet having an associated win condition structured such that it is easier to win the bet the more players there are placing or participating in the bet. In some embodiments in which a bet is implemented as a community bet in which winning players share a progressive jackpot amount, improving the odds of winning this type of bet as more players join or place a wager on the bet may be implemented in order to offset the fact that each player who joins the bet will be sharing a progressive jackpot amount with more people. For example, assuming ten (10) players elect to place a wager on the same Number Run bet, a win condition may be set such that the players win the bet and share a jackpot amount if seventeen (17) consecutive numbers land without a repeat. But if twenty (20) players elect to place a wager on the same Number Run bet, the win condition may be set such that the players win the bet and share a jackpot amount if only fifteen (15) consecutive numbers land without a repeat. Improving a win condition such that a Number Run bet (or other type of bet the result of which is dependent on a plurality of consecutive, independently-determined outcomes) is easier to win (e.g., fewer consecutive non-repeating numbers must be achieved in consecutive, independently determined outcomes) as more people join the bet may encourage players to play at peak times (so the win condition is easier to satisfy) rather than avoiding joining the bet when other people are playing (in order to avoid sharing the jackpot with more people). In some embodiments, a maximum number of players may be set for a particular community bet (e.g., no more than 100 players may ever join a particular Number Run bet once it becomes available).

It should be noted when reference is made to a player "joining" a bet or choosing to "participate" in a bet, this is intended to indicate that the player places a wager in accordance with the parameters defining the bet as output to the player by the system (e.g., the player places a wager of a defined amount, based on defined odds and in accordance with a defined win condition, such that the player wins the bet based on the defined odds if the defined win condition is satisfied). A player who "joins" a community bet or chooses to participate in a community bet places a wager along with other players to whom the community bet is made available. In some embodiments all players who join or participate in a community bet may share a payout (e.g., from a prize pool based on the wagers of the players who are participating in the bet) while in other embodiments any player who wins a community bet wins a set or predetermined amount that is not based on the bet amounts or number of players participating in the bet.

Certain aspects, advantages, and novel features of various embodiments of a roulette game are described herein. It is to be understood that not necessarily all such advantages may be achieved in accordance with any particular embodiment. Thus, for example, those skilled in the art will recognize different embodiments may be implemented or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

A "game", as the term is used herein unless specified otherwise, may comprise any game (e.g., wagering or non-wagering, electronically playable over a network) playable by one or more players in accordance with specified rules. A game may be playable on a personal computer online in web browsers, on a game console and/or on a mobile device such as a smartphone or tablet computer. A game may also be playable on a dedicated gaming device (e.g., a slot machine in a brick-and-mortar casino). "Gaming" thus refers to play of a game.

A "casual game", as the term is used herein unless specified otherwise, may comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game", as used herein unless specified otherwise, refers to a type of online game that is played through a social network, and in some embodiments may feature multiplayer and asynchronous game play mechanics. A "social network" may refer to an online service, online community, platform, or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a browser game, but can also be implemented on other platforms such as mobile devices.

A "wagering game", as the term is used herein, may comprise a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" refers to play of a wagering game.

The term "game provider", as used herein unless specified otherwise, refers to an entity or system of components which provides, or facilitates the provision of, games for play and/or facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may operate or facilitate a gambling website over which wagers are accepted and results of wagering games are provided.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

An "game event", "event instance", "game instance", "spin" or "turn" is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance). An event instance or turn may comprise an event instance or turn of a primary game or an event instance or turn of a bonus round, mode or feature of the game.

"Virtual currency" as the term is used herein unless indicated otherwise, refers to an in-game currency that may be used as part of a game or one or more games provided by a game provider as (i) currency for making wagers, and/or (ii) to purchase or access various in-game items, features or powers. References to an "award", "prize" and/or "payout" herein are intended to encompass such in the form of virtual currency, credits, real currency or any other form of value, tangible or intangible.

A "credit balance", as the term is used herein unless indicated otherwise, refers to (i) a balance of currency, whether virtual currency or real currency, usable for making wagers or purchases in the game (or relevant to the game), and/or (ii) another tracking mechanism for tracking a player's success or advancement in a game by deducting therefrom points or value for unsuccessful attempts at advancement and adding thereto points or value for successful attempts at advancement. A credit balance may be increased or replenished with funds external to the game. For example, a player may transfer funds to the credit balance from a financial account or a gaming establishment may add funds to the credit balance due to a promotion, award or gift to the player.

Referring now to the figures, FIG. 1 depicts a block diagram of an example system 100 according to some embodiments. The system 100 may comprise a plurality of player devices 102*a*-102*n* in communication with a game server 110 via a network 104. For purposes of brevity, any or all of the player devices 102*a*-102*n* will be referred to as a player device 102 herein, even though the plurality of player devices 102*a*-102*n* may include different types of player devices (as described below). The game server 110 may also be operable to communicate with or access a database 140 (which may comprise one or more databases and/or tables and which may comprise a storage device distinct from (or be a component of) the game server 110). It should be noted that in some embodiments database 140 may be stored on a game server 110 while in other embodiments database 140 may be stored on another computing device with which game server 110 is operable to communicate in order to at least access the data in database 140 (e.g., another server device remote from game server 140, operable to determine outcomes for an event instance of a game). In some embodiments a processor (e.g., one or more microprocessors, one or more microcontrollers, one or more digital signal processors) of a player device 102 and/or game server 110 may receive instructions (e.g., from a memory or like device), and execute those instructions, thereby performing one or more processes defined by those instructions.

Instructions may be embodied in, e.g., one or more computer programs and/or one or more scripts.

In some embodiments a game server 110 and/or one or more of the player devices 102 stores and/or has access to data useful for facilitating play of a game. For example, game server 110 and/or a player device 102 may store (i) one or more probability databases for determining one or more outcome(s) for an event instance, spin or turn of a game, (ii) a current state or status of a game or game session (e.g., a number of spins defined by a bet and a number of spins which have already been executed in order to determine a win result for the bet and the respective outcome(s) of the spins), (iii) one or more user interfaces for use in a game, (iv) one or more game themes for a game and/or (v) profiles or other personal information associated with a player of a game. It should be noted that in some embodiments such data may be stored on the game server 110 and information based on such data may be output to a player device 102 during play of a game while in other embodiments a game program may be downloaded to a local memory of a player device 102 and thus such data may be stored on a player device 102 (e.g., in encrypted or other secure or tamper-resistant form).

A game server 110 may comprise a computing device for facilitating play of a game (e.g., by receiving an input from a player, determining an outcome and/or result for a game or game event, causing an outcome of a game to be displayed on a player device, determining a win result for a bet encompassing a plurality of spins or other game events, facilitating a wager and/or a provision of a payout for a game). For example, the game server 110 may comprise a server computer operated by a game provider or another entity (e.g., a social network website not primarily directed at providing games). In some embodiments, the game server may determine an outcome for spin of a game by requesting and receiving such an outcome from another remote server operable to provide such outcomes. In some embodiments, the game server 110 may further be operable to facilitate a game program for a game (e.g., a wagering game). In accordance with some embodiments, in addition to administering or facilitating play of a game, a game server 110 may comprise one or more computing devices responsible for handling online processes such as, but not limited to: serving a website comprising one or more games to a player device and/or processing transactions (e.g., wagers, deposits into financial accounts, managing accounts, controlling games, etc.). In some embodiments, game server 110 may comprise two or more server computers operated by the same entity (e.g., one server being primarily for storing states of games in progress and another server being primarily for storing mechanisms for determining outcomes of games, such as a random number generator).

Turning now to a description of a player device 102, in accordance with some embodiments a player device 102 may comprise a computing device that is operable to execute or facilitate the execution of a game program and used or useful by an online player for accessing an online casino or other electronic (e.g., online) game provider. For example, a player device 102 may comprise a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™ Xbox 360™, Sony™ PlayStation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, game server 110. A player device 102 may be a dedicated gaming device (e.g., a slot machine) or a non-dedicated gaming device (e.g., an iPad™). It should be noted that a game server 110 may be in communication with a variety of different types of player devices 102.

A player device 102 may be used to play a wagering or non-wagering game (e.g., a social or casual game) over a network and output information relating to the game to players participating in the game (e.g., outcomes for an event instance of the game, qualifying for a bonus round of the game, outcomes determined for a bet, a win result of a bet, credit balance of credits available for play of the game, etc.). Any and all information relevant to any of the aforementioned functions may be stored locally on one or more of the player devices 102 and/or may be accessed using one or more of the player devices 102 (in one embodiments such information being stored on, or provided via, the game server 110). In another embodiment, a player device 102 may store some or all of the program instructions for determining, for example, (i) that an event instance or game instance (e.g., a spin of a virtual roulette game) has been triggered or initiated (and, in some embodiments, communicating such a trigger or initiation to game server 110), (ii) a win result for a bet (e.g., which may be dependent on a plurality of outcomes), and/or (iv) modifying a game interface to reflect events within the game (e.g., generate data or information, based on data received from a random number generator or other component of the system; modify the game interface to indicate an outcome and a current status of a bet). In some embodiments, the game server 110 may be operable to authorize the one or more player devices 102 to access such information and/or program instructions remotely via the network 104 and/or download from the game server 110 (e.g., directly or via an intermediary server such as a web server) some or all of the program code for executing one or more of the various functions described in this disclosure. In other embodiments, outcome and result determinations may be carried out by the game server 110 (or another server with which the game server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as in a casino or internet café) or remote from all other player devices 102. Similarly, any given player device may be located at the same location as the game server 110 or may be remote from the game server 110. It should further be noted that while the game server 110 may be useful or used by any of the player devices 102 to perform certain functions described herein, the game server 110 need not control any of the player devices 102. For example, in one embodiment the game server 110 may comprise a server hosting a website of an online casino accessed by one or more of the player devices 102.

In one embodiment, a game server 110 may not be necessary or desirable. For example, some embodiments described in this disclosure may be practiced on one or more player devices 102 without a central authority. In such an embodiment, any functions described herein as performed by a game server 110 and/or data described as stored on a game server 110 may instead be performed by or stored on one or more player devices 102. Additional ways of distributing information and program instructions among one or more player devices 102, a game server 110 and/or another server device will be readily understood by one skilled in the art upon contemplation of the present disclosure.

Figure 2:
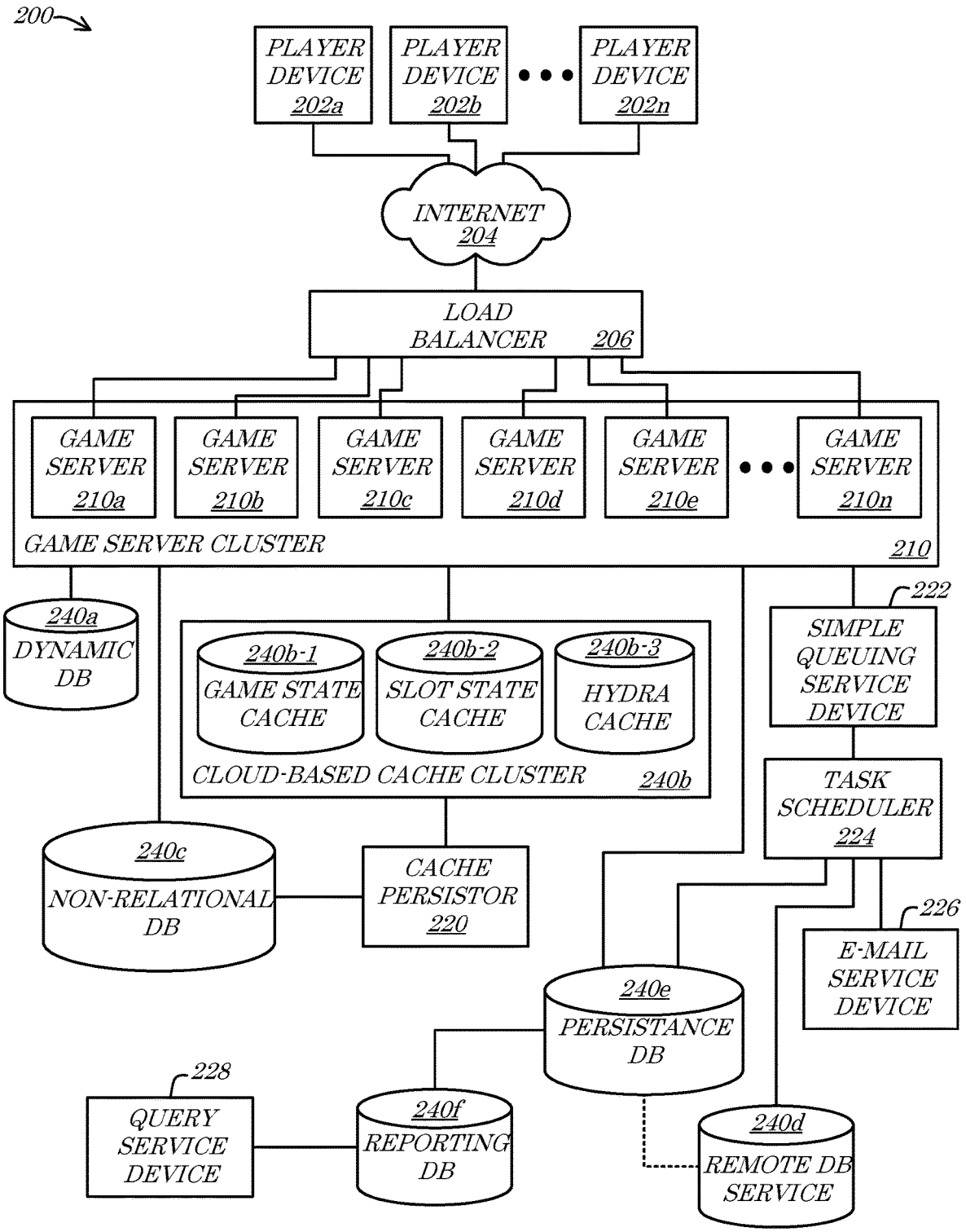
FIG. 2 is a schematic diagram of an embodiment of a gaming platform in accordance with one or more embodiments described herein.

FIG. 2 a block diagram of an example system 200, which is consistent with some embodiments. In accordance with some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200.

According to some embodiments, the player device 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slots, poker, and/or other games of chance, skill, and/or combinations thereof. In some embodiments, the various game servers 210*a-n* (virtual and/or physical) of the game server cluster 210 may be configured to provide, manage, host, and/or conduct individual instances of available game types. A first game server 210*a*, for example, may host a first particular instance of an online roulette game (or tournament), a second game server 210*c* may host a second particular instance of an online roulette game (or tournament), a third game server 210*c* may facilitate an online poker tournament, and/or a fourth game server 210*d* may provide an online slots game.

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer. In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/stickiness). In some embodiments, the load balancer 206 may comprise one or more devices and/or services provided by a third-party (not shown). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for some game types the game server cluster 210 may provide game outcomes to a controller device (not separately shown in FIG. 2) that times the release of game outcome information to the player devices 202*a-n* such as by utilizing a broadcaster device (also not separately shown in FIG. 2) that transmits the time-released game outcomes to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DynamoDB™ service provided by Amazon® Web Services, LLC. The dynamic DB 240*a* may, for example, store information specific to one or more certain game types (e.g., a reeled slots themed game) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, slot state (e.g., slot-game specific state) data may be stored in the slot state cache 240*b*-2, and/or other game and/or player information (e.g., progressive data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistor 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve spin and/or other game event info and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

Figure 3:
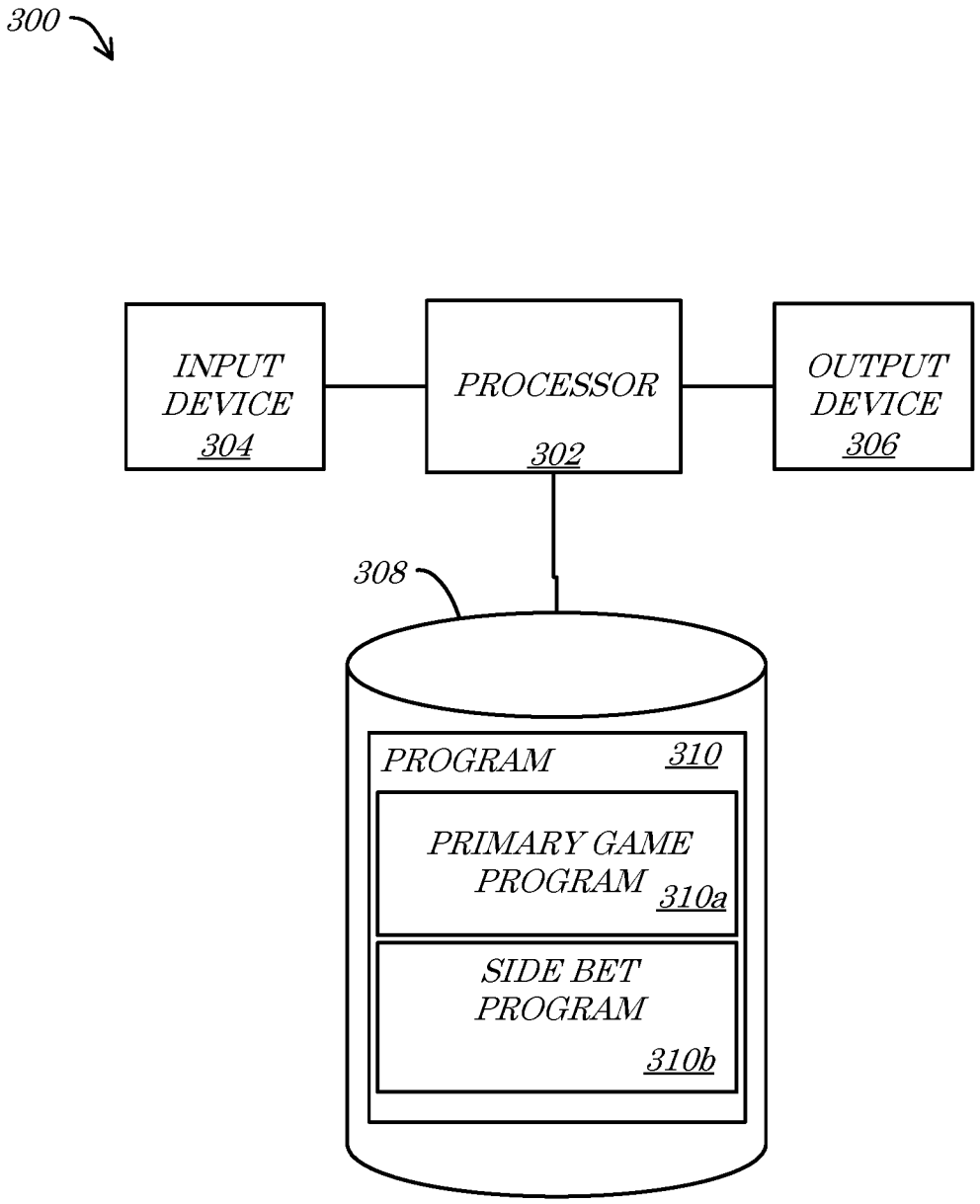
FIG. 3 is a block diagram of an embodiment of a computing device useful in a system according to one or more embodiments described herein.

FIG. 3 is a block diagram of an apparatus 300 according to some embodiments. In some embodiments, the apparatus 300 may be similar in configuration and/or functionality to any of the player devices 102, the game server 110 and/or another server device operable to facilitate the embodiments described herein. The apparatus 300 may, for example, execute, process, facilitate, and/or otherwise be associated with any of the processes described herein.

In some embodiments, the apparatus 300 may comprise a processor 302, an input device 304, an output device 306 and/or a memory device 308. Fewer or more components and/or various configurations of the components 302, 304, 306 and/or 308 may be included in the apparatus 300 without deviating from the scope of embodiments described herein.

According to some embodiments, the processor 302 may be or include any type, quantity, and/or configuration of processor that is or becomes known. The processor 302 may comprise, for example, an Intel® IXP 2800 network processor or an Intel® XEON™ Processor coupled with an Intel® E7501 chipset. In some embodiments, the processor 302 may comprise multiple inter-connected processors, microprocessors, and/or micro-engines. According to some embodiments, the processor 302 (and/or the apparatus 300 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 302 comprises a server such as a blade server, necessary power may be supplied via a standard AC outlet, power strip, surge protector, and/or Uninterruptible Power Supply (UPS) device.

In some embodiments, the input device 304 and/or the output device 306 are communicatively coupled to the processor 302 (e.g., via wired and/or wireless connections and/or pathways) and they may generally comprise any types or configurations of input and output components and/or devices that are or become known, respectively.

The input device 304 may comprise, for example, a keyboard that allows an operator of the apparatus 300 to interface with the apparatus 200 (e.g., by a player, an employee or other worker affiliated with either an online casino or other entity operating a system which provides games to players). In some embodiments, the input device 304 may comprise a mechanism configured to indicate to a remote server device an initiation or triggering of an event instance (e.g., that a player has actuated a "wheel spin" mechanism (e.g., a "soft" or virtual button on an online game interface) and thus initiated a new spin of an online roulette game), such information being provided to the apparatus 300 and/or the processor 302. In such embodiments, the input device may comprise a key on a keyboard of the apparatus 300 or a touch-sensitive screen of a device. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a microphone, an infrared sensor, a sonic ranger, a computer port, a video camera, a motion detector, a digital camera, a network card, a Universal Serial Bus (USB) port, a GPS receiver, a Radio Frequency Identification (RFID) receiver, a RF receiver, a thermometer, a pressure sensor, and a weight scale or mass balance.

The output device 306 may, according to some embodiments, comprise a display screen and/or other practicable output component and/or device that is operable to output information. The output device 306 may, for example, comprise a display screen via which are output outcomes, instructions, guidance, questions or information to a player of a game. For example, the output device may output a game interface for a game which indicates an outcome of an event instance of the game, such as an outcome for a spin of a roulette wheel and/or a win result for a bet dependent on a plurality of outcomes. FIGS. 4A-4D, described herein, comprise examples of an online roulette game interface that may be output in accordance with at least some embodiments described herein.

Some additional examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, the input device 304 and/or the output device 306 may comprise and/or be embodied in a single device such as a touch-screen display or screen.

In some embodiments, the apparatus 300 may comprise any type or configuration of communication device (not shown) that is or becomes known or practicable. For example, the apparatus 300 may include a communication device such as a NIC, a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., an initiation of an event instance) to a server (e.g., game server 110) in communication with a plurality of player devices 102. According to some embodiments, the communication device may also or alternatively be coupled to the processor 302. In some embodiments, the communication device may comprise an IR, RF, Bluetooth™, and/or Wi-Fi® network device coupled to facilitate communications between the processor 202 and another device.

The memory device 308 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 308 may, according to some embodiments, store a program 310 for facilitating one or more of the embodiments described herein, which program may include a primary game program 310*a* for facilitating a primary aspect of a game and a side bet program 310*b* for facilitating a bonus round of the game, which may be relevant to some embodiments. In some embodiments, the primary game program 310*a* and/or the side bet program 310*b* may be utilized by the processor 302 to provide output information via the output device 306.

The apparatus 300 may function as a computer terminal and/or server of an online casino or other entity operating to provide online games, receive and/or manage information related to online games. In some embodiments, the apparatus 300 may comprise a web server and/or other server device operable to accept wagers and determine random numbers based upon which outcomes for wagering games are determined. In some embodiments, the apparatus 300 may comprise an apparatus that is operable to interact with a player of an online game. In some embodiments, apparatus 300 may comprise a plurality of devices working together to accomplish the functionality described herein with respect to FIG. 3.

Any or all of the exemplary instructions and data types described herein and other practicable types of data may be stored in any number, type, and/or configuration of memory devices that is or becomes known. The memory device 308 may, for example, comprise one or more data tables or files, databases, table spaces, registers, and/or other storage structures. In some embodiments, multiple databases and/or storage structures (and/or multiple memory devices 308) may be utilized to store information associated with the apparatus 300. According to some embodiments, the memory device 308 may be incorporated into and/or otherwise coupled to the apparatus 300 (e.g., as shown) or may simply be accessible to the apparatus 200 (e.g., externally located and/or situated).

Figure 4A:
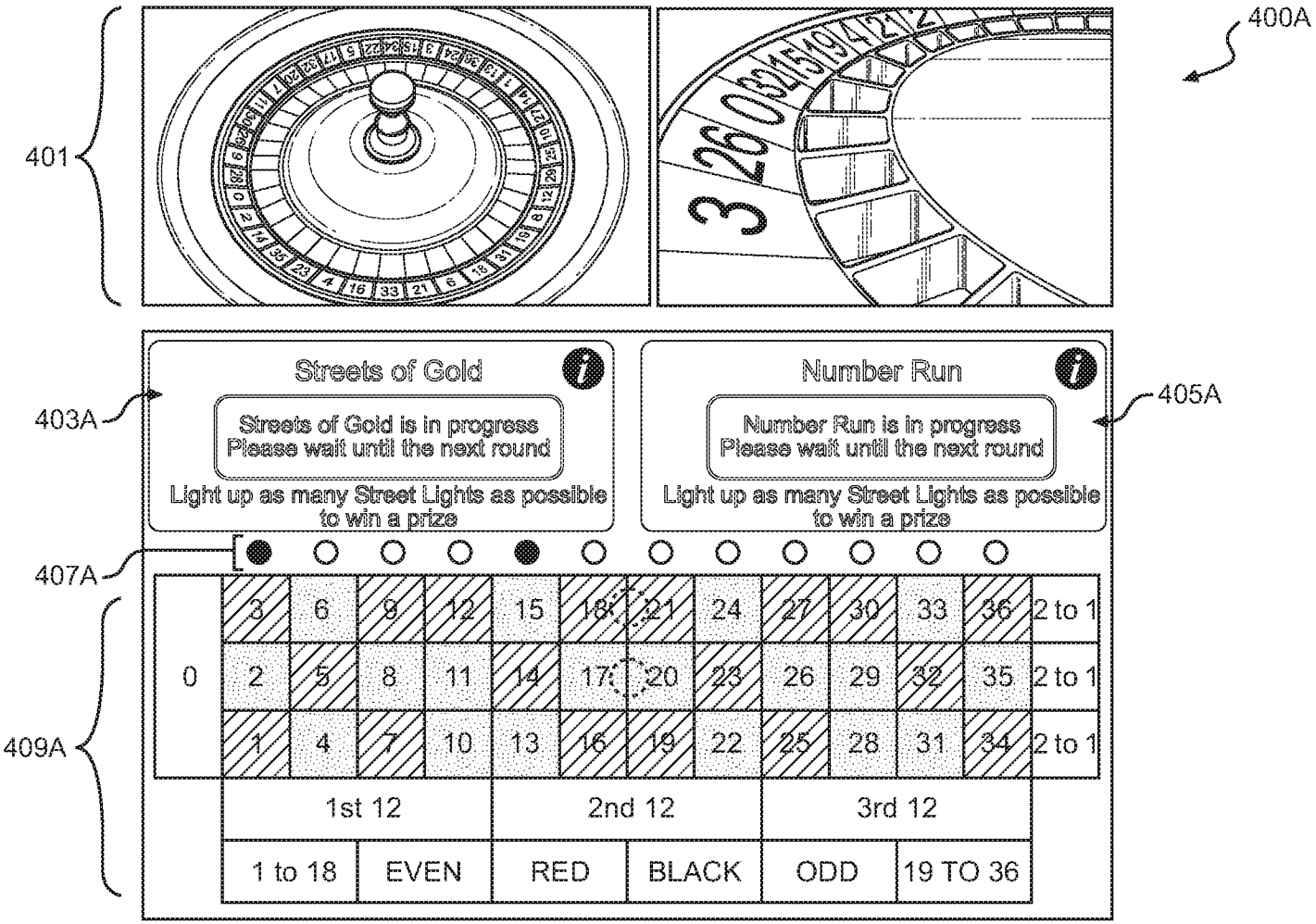
FIGS. 4A-4E illustrate a graphical user interface for facilitating an electronic roulette game, as it is modified to indicate progress for a multi-spin wager, in accordance with some embodiments described herein.
Figure 4B:
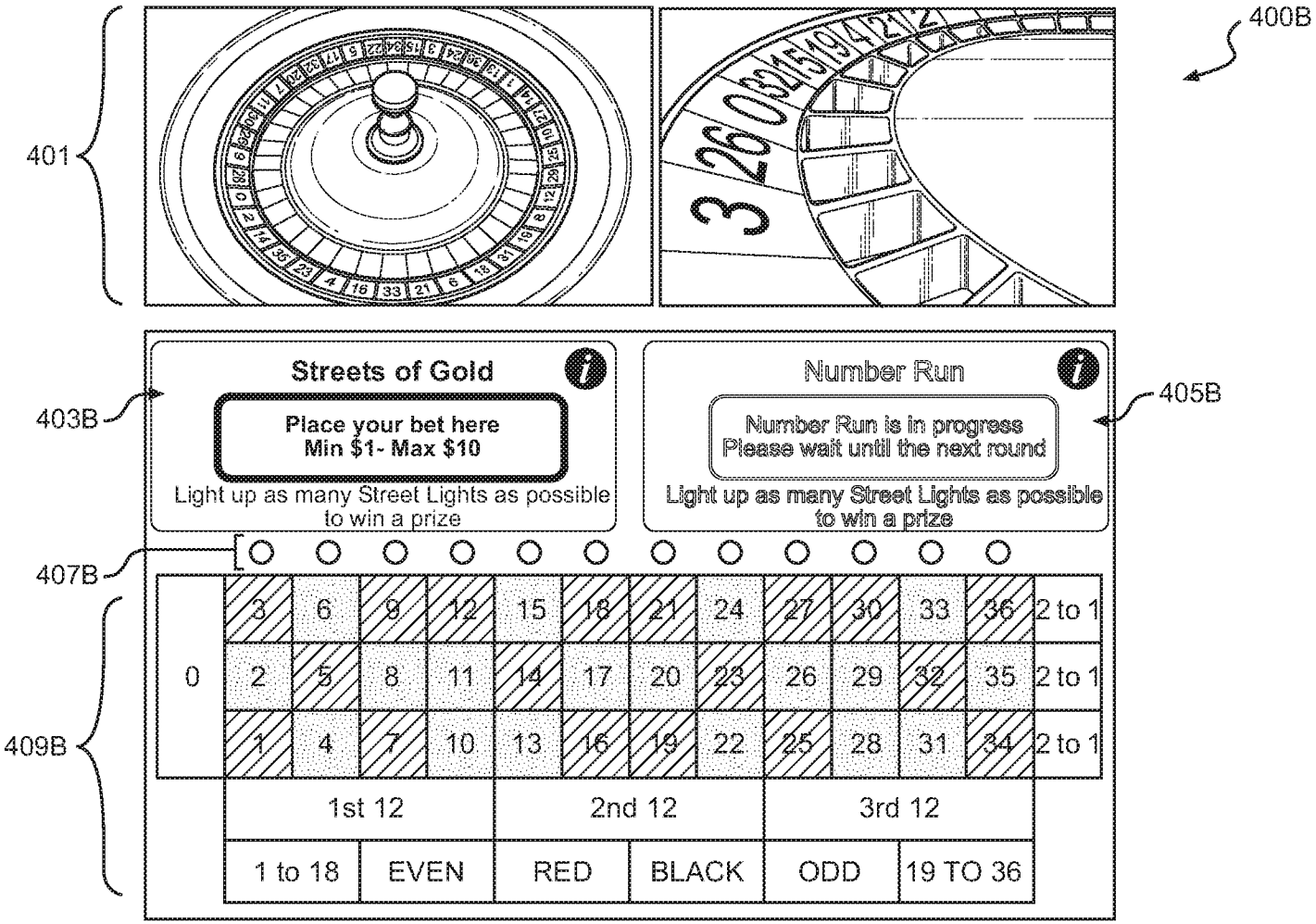

Referring now to FIGS. 4A-4E, consistent with one embodiment there is provided a graphical user interface (GUI) 400 (referred to as GUI 400A with respect to FIG. 4A, GUI 400B with respect to FIG. 4B, etc.). As is well known, graphical user interfaces are arranged to display information regarding a program, software application or other element associated with a computing device. In accordance with one embodiment, the GUI 400 is associated with a program comprising one or more sub-routines, modules or functions. In one embodiment, GUI 400 is associated with a program for facilitating an electronic roulette game playable by a user via a player device (e.g., a mobile device such as a smartphone or tablet computer). For example, GUI 400 may be associated with program 310 (FIG. 3), as described in more detail herein. In one more specific example, in some embodiments a player device may access a server device as a client via a browser on the player device and the player may play a game consistent with at least some embodiments described herein by accessing the game interface using a browser rather than having game logic downloaded to the player device. Thus, in some embodiments GUI 400 may comprise a game interface output in a display of a player device via a web browser of the player device.

In accordance with some embodiments, GUI 400 may be arranged to display information associated with a program for facilitating an electronic roulette game and permit interaction with (e.g. provide input to the program), whether directly or indirectly, the computing device which is running or performing the program. In one embodiment, the GUI 400 comprises a mechanism for one or more computing devices to output game data to a player via a display of a player device (e.g., by displaying the GUI 400 via a web browser of the player device) and/or receive data from a player, and thereby perform one or more programs or sub-routines for facilitating an electronic roulette game. For example, some elements of the GUI 400 may comprise input mechanisms (e.g., virtual buttons actuatable by the player via a cursor or via a touch if the GUI 400 is being displayed via a touchscreen of a player device) and the inputs provided by the player to the GUI 400 may be transmitted to the computing device (e.g., apparatus 300) which is operable to determine data and progress in the game based on the inputs (e.g., a computing device operable to perform process 500, described herein).

GUI 400 will initially be described with respect to FIG. 4A but many elements of GUI 400A of FIG. 4A are also included in FIGS. 4B-4E (and therefore in GUI 400B-400E) and it should be understood that the descriptions of the elements common to the representations of GUI 400 in FIGS. 4A-4E may be applied to each such figure without needing to be repeated with respect to each individual figure. An element which is common among the FIGS. 4A-4E is labelled with the same reference numeral in each figure.

In accordance with one embodiment, the GUI 400 may comprise a plurality of windows or areas of a variety of shapes and sizes (which shapes and sizes may be modified during a course of a game event, to allow for clearer representations of information to a player). In accordance with some embodiments, a first window 401 is for displaying a representation of a roulette wheel (e.g., a virtual roulette wheel which may be animated to illustrate a spinning thereof and an animation of a virtual ball landing in a particular portion of the virtual wheel). In accordance with some embodiments, the window 401 includes both a farther-out view of a roulette wheel and a close-up view of the roulette wheel. The close-up view may, for example, be particularly useful in outputting an outcome of a game event (e.g., the roulette wheel graphic may be animated to show it spinning and then a ball may be shown as landing on the number/color comprising the outcome).

In accordance with some embodiments, GUI 400 also includes two windows 403A and 405A, for outputting information about different side bets that may or may not be available in accordance with some embodiments. In the example embodiment of FIG. 4A, window 403A is outputting information regarding a Streets of Gold side bet, indicating that it is currently unavailable (the unavailability being indicated both by the text being output and the grayed-out or faded format of the font). In the example embodiment of FIG. 4A, window 405A is outputting information regarding a Numbers Run side bet, also indicating via the text and grayed-out format of the font that this bet is also currently unavailable for joining. As indicated in both window 403A and window 405A, the reason these side bets are currently unavailable is because they are currently in progress (meaning the result of these side bets is currently being resolved, based on the outcomes of the roulette game being output).

It should be noted that, in accordance with some embodiments, if the player to whom the game interface is being output did not join the Number Run side bet when it was previously made available for joining, the progression or resolution of the win condition for this side bet may not be output to the player (e.g., the numbers being output as outcomes contributing to the determination of the win result of the side bet may not be output to the player, the player may simply be informed that the Number Run side bet is currently in progress and is not currently available for joining by the player). Thus, in accordance with such an embodiment, in FIG. 4A it may be assumed that the player to whom GUI 400A is being output did not choose to join the Number Run side bet when it was previously made available for joining and thus the status or progress as to the resolution of this side bet vis-à-vis this particular player is not being output, since the outcomes the player is obtaining for a current sequence of consecutive outcomes do not effect a result of the Number Run side bet. In other embodiments, even if a player did not choose to join a side bet, the player's outcomes as they are obtained while that side bet is being resolved may be output in a manner that indicates to the player what the result vis-à-vis the player would have been for that side bet had the player joined the side bet when it had been available.

In accordance with some embodiments, area 407A is an area for indicating progress or a current status for a Streets of Gold side bet. It may be assumed, for purposes of FIG. 4A, that the player to whom GUI 400A is being output did previously choose to join the Streets of Gold side bet that is currently being resolved and thus the progress of this side bet, based on the outcomes being obtained by the player, is being output to the player via the GUI 400A. In accordance with some embodiments, there is a circle or "light" above each column or "street" of numbers of the roulette game layout displayed in area 409A. Once a round or instance of a Streets of Gold side bet is initiated and the resolution thereof begun (or the output of the outcomes for the Streets of Gold side bet is begun), the appropriate circle or light in area 407A may be "lit up" or its appearance in some way may be modified to indicate that a number in the corresponding column or street directly below it has been obtained for the current round. Thus, by looking at which circles are lit up in area 407A, a player may keep track of which streets have already been "hit" and, as an outcome of the next spin of the roulette wheel is output, the player can see whether this outcome ends his Streets of Gold side bet (if it the outcome for a current spin is a number/color in a street that has already been hit by a previous outcome).

In accordance with some embodiments, the side bets are currently unavailable for joining because a respective result for each of a previously initiated Streets of Gold side bet and a Number Run side bet (which may have been joined by a plurality of players) is being resolved as consecutive independently determined outcomes of the roulette game are being determined. In the example scenario being illustrated in FIG. 4A, two filled-in circles above two different streets (one above the first street from the left and one above the fifth street from the right) indicate which streets have hit already (i.e., streets which include a number/color combination which corresponds to a number/color of the wheel on which the ball of the roulette wheel has landed during the determination of the result for the side bet). In accordance with some embodiments, the Streets of Golds side bet ends when one of these already "hit" streets is hit again.

Area 409A displays an indication of numbers (and corresponding colors, indicated by different background shading in each color) on which a player may wager as well some pre-defined wagers available for selection by the player ("1-18", "Even", "Red" (indicated by dotted background), "Black" (indicated by hashed lined background), "Odd" and "19-36). A player may place a primary wager in the roulette game by, for example, placing a virtual chip or token on a particular number, color or pre-defined wager in the roulette game layout of area 409A. In the example of FIG. 4A, for example, an indication of a chip on the line between the numbers "18" and "21" in the first row and another indication of a chip on the line between the numbers "17" and "20" in the second row each represent a respective primary wager placed by a player to whom the GUI 400A is being output.

Referring now to FIG. 4B, illustrated therein is an example game interface 400B similar to the GUI 400A of FIG. 4A but at a time at which the Streets of Gold bet is available for players to join. The availability to join the Streets of Gold side bet is indicated in area 403B, both via the text displayed therein and the darker (not grayed-out) format of the font thereof. Area 403B also indicates that the wager amount for the Streets of Gold may be between a minimum wager of $1 and a maximum wager of $10 (in some embodiments the GUI may include a mechanism via which the player may select a particular wager amount for a particular side bet the player is joining, from a menu of predetermined wager size options, or may otherwise input his desired wager size). Thus, in accordance with some embodiments, once a player elects to join the side bet and indicates his desired wager value, the appropriate amount of value may be deducted from a credit meter balance associated with the player.

As in FIG. 4A, the Number Run side bet (indicated in area 405B in grayed-out font) is not currently available for joining. It should be noted that, as in the embodiment of FIG. 4A, it may be assumed that the player to whom the game interface 400B is being output did not join the Number Run side bet when it was previously made available for joining, and thus the progression or resolution of the win condition for this side bet is not being output to the player (in accordance with some embodiments). In accordance with some embodiments, the Streets of Gold side bet may be made simultaneously available and output as such to all players participating in the roulette game (or to a predetermined number of players) until the betting or joining window closes and the result of the side bet begins to be determined over the next plurality of outcomes. Players either elect to join in or not. If they do not join in they must wait until it next becomes available. A joining window (i.e., window of time or opportunity) may close when a closing condition is satisfied. A closing condition may comprise, for example, (i) a passage of a predetermined period of time from a time at which the side bet became available for joining by the player; (ii) a maximum number of players joining the side bet; or (iii) one of the players who has elected to join the side bet initiating a spin of a roulette wheel and thus initiating a determination of a result of the side bet.

In accordance with some embodiments, since the Streets of Gold side bet is currently indicated as available in FIG. 4B, the determination or output of a progress or result of the side bet is not yet being output and thus none of the circles in area 407B of the GUI 400B are filled in or "lit up." Area 407B, at this particular time, does not yet indicate any primary bets placed by the player.

Figure 4C:
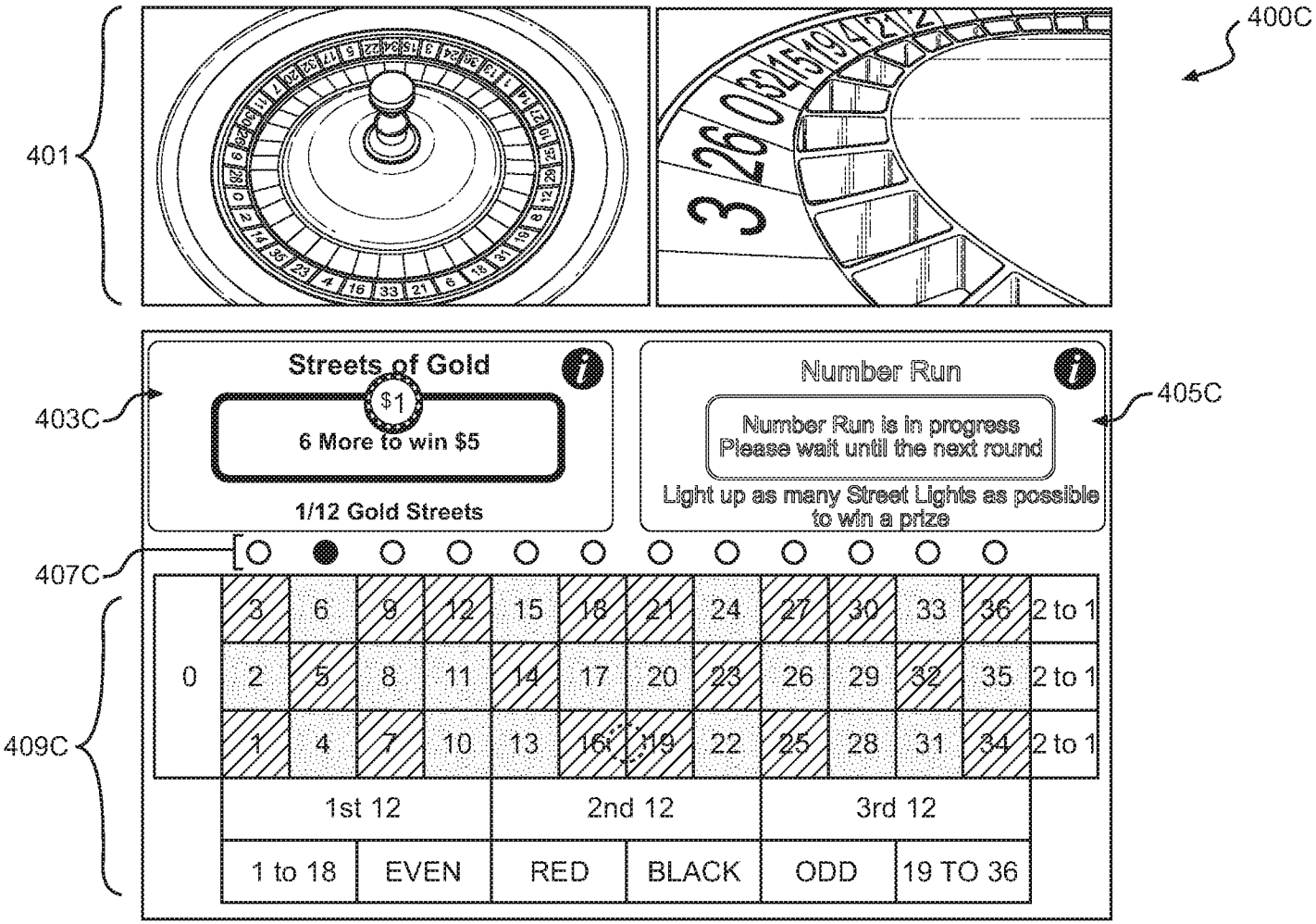

Referring now to FIG. 4C, illustrated therein is GUI 400C, showing the GUI 400 as it was modified based on game events since GUI 400B was output (FIG. 4B). In particular, it may be assumed that the player to whom GUI 400B was output has elected to join the Streets of Gold side bet (e.g., by actuating a virtual button or selecting an input mechanism associated with the GUI, not shown) but not the Number Run side bet (as indicated by the grayed-out font in area 405C). GUI 400C illustrates, in area 403C, a current status of the resolution of the Streets of Gold side bet, after one outcome in a consecutive series of outcomes usable for resolving the Streets of Gold side bet has been obtained and output to the player. As shown in area 403C, six (6) more streets or rows have to be hit (without obtaining a number in a street that has already been hit for the current side bet) in order for the player to win the side bet (i.e., a win condition for the side bet is that 7 different streets have to be hit in a series of consecutive outcomes, before any street is repeated). As indicated by the single filled-in circle in area 407C, above the second column or street of numbers from the left in area 409C, one street has been hit thus far. One may infer from this that one of the numbers in the second column in area 409C comprised the first outcome in the consecutive series of outcomes that was determined for this side bet.

Figure 4D:
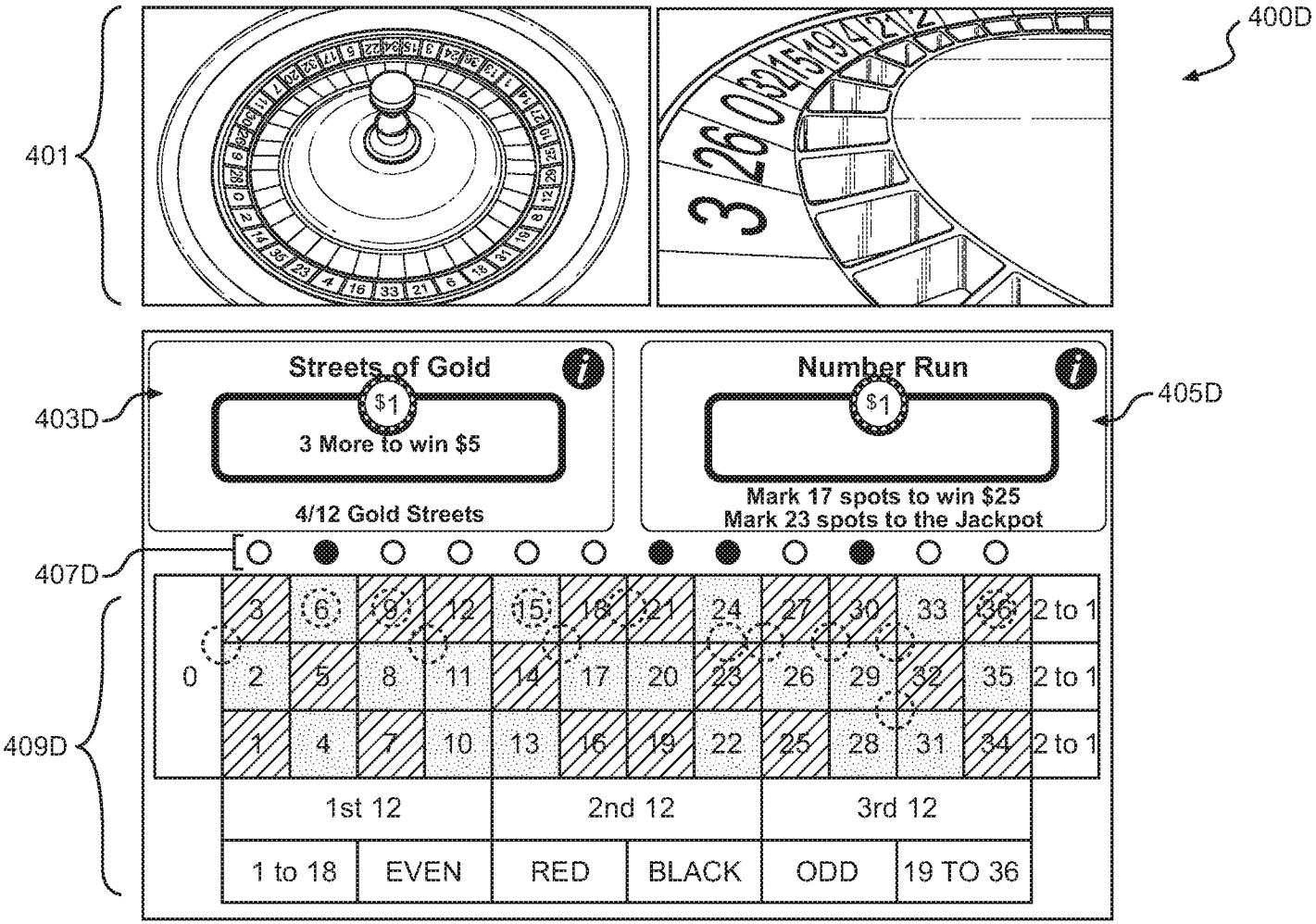

Referring now to FIG. 4D, illustrated therein is a GUI 400D, showing as it was modified based on game events since GUI 400C was output (FIG. 4C). In particular, (i) area 403D and area 407D each indicate additional progress in the resolution of the Streets of Gold side bet since that indicated in GUI 400C; and (ii) area 405D indicates that a new Number Run side bet is currently available for the player to join. In accordance with some embodiments a previously available Number Run side bet may have been resolved and now a new Number Run side bet may have been made available to players. The particular Number Run side bet being offered in area 405D indicates that (i) a first win condition associated with this side bet is obtaining seventeen (17) different numbers in seventeen (17) consecutive spins (i.e., without duplicating a number over the course of the seventeen (17) spins of the wheel), corresponding to a prize of $25; and (ii) a second win condition associated with this side bet is obtaining twenty-three (23) different numbers in twenty-three (23) consecutive spins (i.e., without duplicating a number over the course of the twenty-three (23) spins of the wheel), corresponding to a Jackpot prize of an unspecified value (in some embodiments the value may be specified, in some embodiments the Jackpot may be a progressive value based on the number of players who join the bet). Area 405D also indicates that the wager amount for the Number Run side bet is $1. Thus, in accordance with some embodiments, $1 of value may be deducted from a credit meter balance associated with the player if the player indicates an acceptance of the offer to join the side bet.

In accordance with some embodiments, a Streets of Gold side bet and a Number Run side bet may be initiated or made available for joining at different times and yet the resolution of the distinct side bets may overlap to some extent (e.g., some outcomes determined for a roulette game may contribute to a determination of a respective win result for both a Streets of Gold side bet and a Number Run side bet even though these side bets were initiated at different times). For example, assume fifteen (15) consecutive and independently determined outcomes are determined for a roulette game and that the Streets of Gold side bet is joined by a player and initiated right before the determination of outcome 1 of the fifteen outcomes but the Number Run side bet is not joined by the player until right before the determination of outcome 6 of the fifteen consecutive outcomes. In such a circumstance, outcomes 1-5 may only be used towards a win result determination of the Streets of Gold side bet while outcomes 6-15 may be used for both a win result determination of the Streets of Gold side bet (assuming this side bet encompasses all 15 outcomes) and the win result for the Number Run side bet (assuming the Number Run side bet encompasses at least 10 outcomes (outcomes 6-15 of the fifteen outcomes)).

With respect to the progress of the Streets of Gold side bet, area 403D indicates that three (3) more streets or rows have to be hit (without obtaining a number in a street that has already been hit for the current side bet) in order for the player to win the side bet and that four (4) streets have so far been hit without the player losing the side bet (numbers in four distinct columns have been obtained as outcomes, without obtaining an outcome for a spin that is in a street that has previously been hit for the current side bet). The particular four (4) streets or columns that have thus far been hit are indicated in area 407D, via the four (4) filled-in circles above the second, seventh, eighth, and tenth columns (from the left) of area 409D.

Figure 4E:
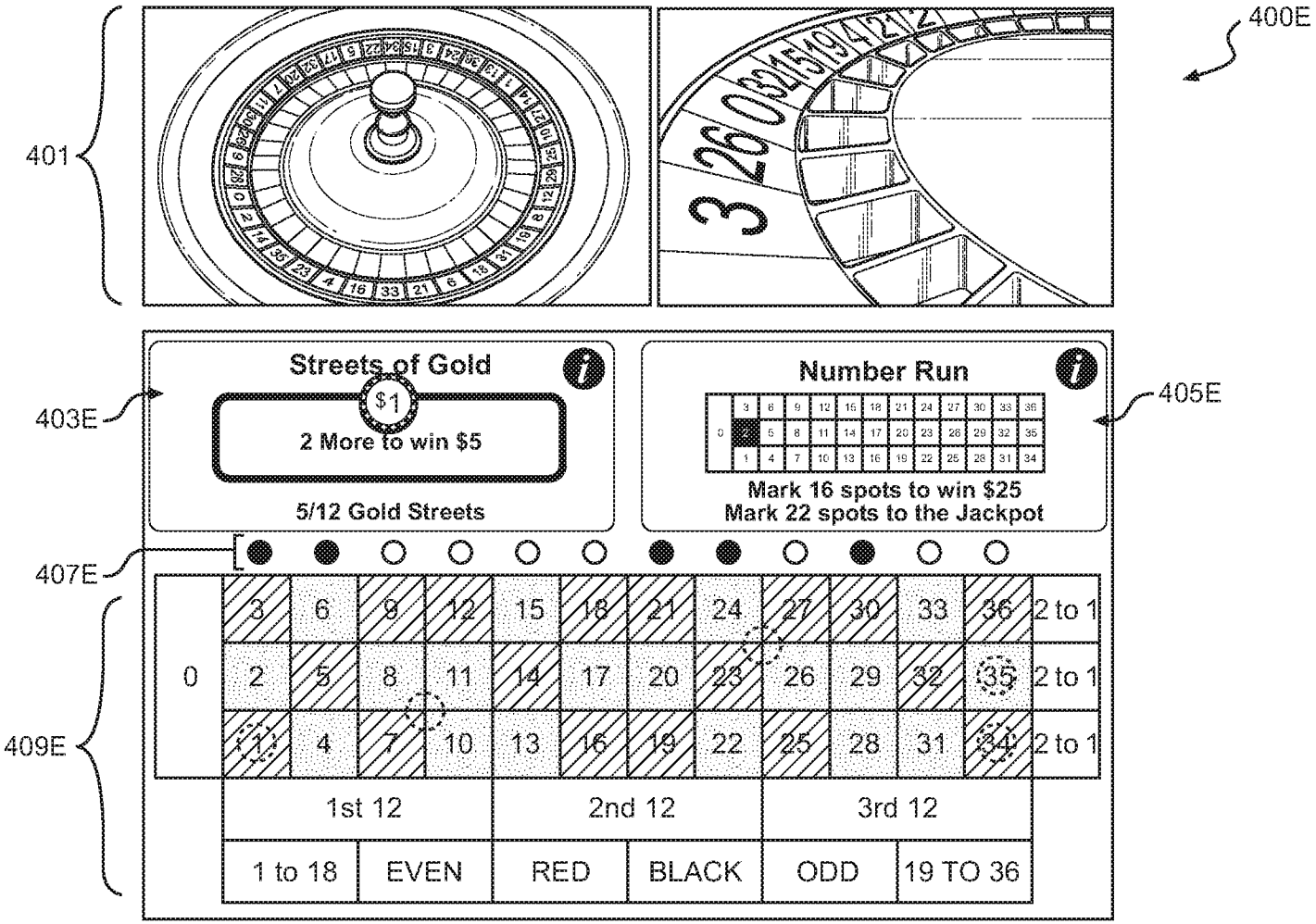

Referring now to FIG. 4E, above, illustrated therein is a GUI 400E that shows a progression of both a Streets of Gold side bet and the Number Run side bet, based on intervening game events, since that shown in GUI 400D (FIG. 4D). The progression of the resolution of the Number Run side bet is output in area 405D while the progression of the resolution of the Streets of Gold side bet is output in areas 403D and 407D.

In accordance with some embodiments, the progression or resolution of the Number Run side bet is output in area 405E if a player elects to join a Number Run side bet (rather than showing a grayed-out indication that a Number Run side bet is currently in progress and not available for joining, as illustrated in FIGS. 4A-4C). In accordance with some embodiments, the progress in the resolution of a Number Run side bet that a player is participating in is indicated via a grid showing all the possible numbers on which a ball of a roulette wheel can land on and marking or indicating (e.g., by changing the background color of the number in the grid) which numbers the ball has already landed on during a resolution of the particular side bet for which a win result is being determined. Thus, as illustrated in area 405E of GUI 400E, it can be seen that a "black 2" has been obtained as an outcome since the player joined the Number Run side bet, as this outcome is filled in on the grid. The text in area 405E also indicates that the sixteen (16) additional unique outcomes must be obtained in order to win the prize of $25 and twenty-two (22) additional unique outcomes must be obtained in order to win the Jackpot prize.

With respect to indicating the progress of the Streets of Gold side bet, area 403E indicates that two (2) more unique streets need to be hit, without duplicating a previously hit street, in order to win the $5 prize and that five (5) unique streets have thus far been hit. Area 407E indicates that, since the data output in GUI 400D, the first street on the left has also been hit (since the "black 2" outcome, the outcome indicated in area 405E as being the outcome that was most recently obtained in the current sequence of consecutive outcomes being obtained by the player, is on this street).

It should be noted that, while the above discussion has focused mainly on the resolution of the Streets of Gold and Number Run side bets that a player has elected to join, the outcomes being obtained during the series of consecutive outcomes being obtained and utilized to track the progress or resolution of these side bets, may also be simultaneously be used to resolve primary wagers. In accordance with some embodiments and as described herein, it is outcomes obtained during play of a primary roulette game that are also used to resolve, over the course of a plurality of spins or rounds of the primary game, a Streets of Gold and/or Number Run side bet. For purposes of brevity, the resolutions of the primary wagers are not illustrated or discussed with respect to FIGS. 4A-4E but it should be understood that even if a particular outcome causes a player to lose a side bet (e.g., because the outcome is a duplicate number and thus ends the Number Run bet without the player having won the bet), the outcome may still result in a win for the player of a primary wager. A resolution of the primary wager (determining whether the player won the primary wager as a result of an outcome determined for a roulette wheel spin) may, in accordance with some embodiments, be a distinct process and determination that is independent from a process or determination of whether an outcome allows a Streets of Gold side bet or Number Run side bet to continue (or be won) or causes such a side bet to be lost. An example of the latter process is described herein with respect to FIG. 5.

It should be understood that various win conditions may be implemented and that the embodiments described herein are not dependent on any particular win condition (e.g., particular number of non-repeating outcomes) which must be satisfied in order for a player to win the corresponding bet. For example, while in some embodiments payouts may be won on a "Streets of Gold" bet if seven (7) or more streets are hit before a street is repeated, in other embodiments payouts may not be won until ten (10) or more streets are hit before a street is repeated.

Similarly, rules for winning a bet may be set in accordance with a preference of a game operator and may, in some embodiments, be set to offset some possible negative aspects of the bet or roulette in general. For example, a bet in accordance with the embodiments described herein may be implemented in accordance with a rule that states that landing on 0 does not have a negative influence on the side bets (it cannot end the side bet). This may soften the negative perception on the wheel landing on 0 as it is in normal roulette play.

As described herein, in some embodiments GUI 400 of FIGS. 4A-4E (or a device on which it is output to a player) may include additional areas, windows, actuatable buttons (virtual or mechanical), fields or mechanisms via which information may be output to a player and/or via which a player may provide input for the game. For example, in some embodiments GUI 400 may include at least one window or area in which is displayed at least one of (i) additional information regarding game outcomes; (ii) available game choices (e.g., available wagers, available wagering chips or wager amounts, etc.), (iii) an available credit meter balance and/or a means of adding additional credit to a credit meter balance; and (iv) a mechanism for initiating a spin or game event and/or for initiating a resolution of a side bet.

In accordance with some embodiments, GUI 400 (or a device on which it is displayed) of FIGS. 4A-4E may include one or more additional elements which permit interaction with an application or function being performed by an associated computing device. For example, GUI 400 may include one or more interactive elements for (i) accessing a payout schedule or rules of the game, (ii) allowing a player to undo or re-bet a previously placed wager, or (iii) causing the computing device to output (e.g., display via a web browser of a mobile device) information, launch a sub-routine or application (e.g., obtain at least one output from a random number generator for use in determining a result for a multi-spin wager) and/or receive player selections of parameters for the game (e.g., a type of wager, denomination amount, etc.).

Figure 5:
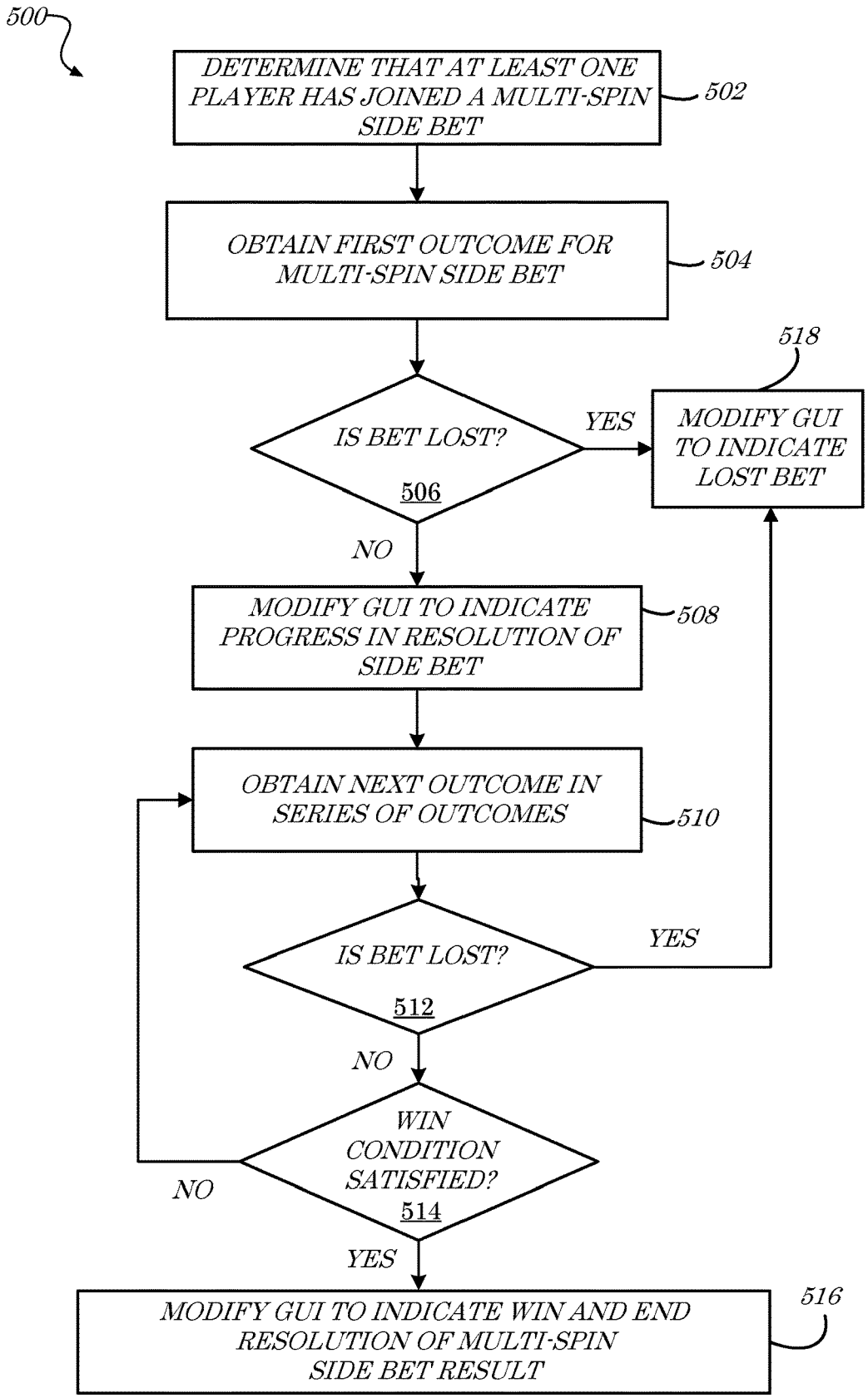
FIG. 5 is a flowchart illustrating a process according to one or more embodiments described herein.

Turning now to FIG. 5, illustrated therein is a process 500 for implementing some of the embodiments described herein. The process 500 may comprise respective processes for implementing a Streets of Gold, Number Run or other multi-spin wager for a roulette game in accordance with embodiments described herein. The process 500 may be performed, for example, by at least one of a server device operable to facilitate an electronic (e.g., online) roulette game and/or a player device enabling a player to play the electronic (e.g., online) roulette game. For example, the process 500 may be performed by at least one of (i) a player device 102 (FIG. 1); (ii) a game server 110 (FIG. 1); (iii) a player device 202 (FIG. 2); (iv) a game server 210 (FIG. 2); and (v) apparatus 300 (FIG. 3). It should be noted that additional and/or different steps may be added to those depicted and that not all steps depicted are necessary to any embodiment described herein. The process 500 is an example process of how some embodiments described herein may be implemented, and should not be taken in a limiting fashion. A person of ordinary skill in the art, upon contemplation of the embodiments described herein, may make various modifications to process 500 without departing from the spirit and scope of the embodiments in the possession of applicants.

In accordance with some embodiments, process 500 begins in step 502 with detecting that a player has joined or accepted an offer for a multi-spin side bet, such as a Streets of Gold or Number Run side bet. This step may, in some embodiments, be preceded with a step of outputting an opportunity for such a side bet to one or more players. Step 502 may comprise at least one of (i) determining a unique identifier of a player who has joined the bet; (ii) determining an identifier or address of a player device via which the player is playing the game; (iii) determining an wager amount for the side bet, as well as any other values for other player-selectable parameters of the side bet; and (iv) updating a database or other memory device to indicate that the player has joined the side bet.

In step 504, the first outcome for determining a resolution of the multi-spin side bet is obtained. For example, a random or pseudo-random number or output from an RNG or other algorithm may be requested and received and the first outcome may be determined based on this output. In some embodiments, the first outcome may be output to the player (e.g., via a GUI such as GUI 400) upon being determined. For example, a virtual roulette wheel may be spun and the ball may be illustrated to land on the number/color portion of the wheel that corresponds to the first outcome. In other embodiments, the first outcome may be determined but not immediately output to the player. For example, the first outcome may not be output until both the first outcome and at least one second outcome is determined, even in embodiments in which an indication of the first result is output first and then an indication of the second result is output.

In step 506, it is determined whether the side bet has been lost as a result of the outcome determined in step 504. For example, in some embodiments certain outcomes or loss conditions may cause a bet to be lost such that subsequent outcomes for subsequent wheel spins do not have an effect on the side bet (e.g., a zero being the outcome for the first outcome of the series of consecutive outcomes may, in some embodiments, cause the player to lose the side bet). In another example, another number may be considered a "losing" number such that landing on it may cause the side bet to be lost immediately. If the side bet is lost as a result of the outcome determined in step 504, the process 500 proceeds to step 518.

In step 518 an indication of the lost bet is output to the player by modifying the GUI in some manner. For example, a message indicating the lost bet may be output (e.g., in a window or area 403 or 405 of GUI 400, depending on which type of side bet has been lost). In some embodiments, an animated graphic may also be output to indicate the loss. In some embodiments, a window or area for tracking progress of the side bet that previously displayed information indicating the progress of the resolution of the side bet may be modified to indicate that the relevant side bet is not currently available. For example, in embodiments in which multiple players can join a side bet, a unique and individual outcome may be determined in step 504 (and in step 510, described below) for each player who joined the side bet (e.g., based on an individual and independently determined Random Number or other output from an RNG). Thus, different outcomes may be determined for the different players who joined the side bet for a given round of the side bet, such that a first player losing the side bet because of a particular outcome obtained by the player for a spin of the roulette wheel does not necessarily mean that the side bet is resolved for all the players or that a new side bet immediately becomes available for joining by the player who lost the side bet. For example, in some embodiments the player who lost the side bet may need to wait until the side bet is resolved for all player who joined the side bet before being able to join a new side bet. This may be particularly true for embodiments in which one or more prizes for the side bet are determined based on the number of players or sum of wagers made for the side bet. In other embodiments, the same outcome for the series of consecutive outcomes used in resolving a side bet are output to all players who joined the side bet (e.g., a single call to an RNG results in the same outcome being used for both a primary game result and a side bet result of all players who joined the side bet). In such embodiments, the different players may still experience different win results for their primary wagers because the player may place primary game wagers that are different from one another even though they are all participating in the same side bet. In embodiments in which the same outcome is used to help resolve a side bet or progress in the resolution of a side bet, an outcome that ends a side bet because the side bet is lost as a result of the outcome may end the side bet for all the participating players and this information may be output to all the players at the same time or essentially the same time.

If it is determined, in step 506, that the side bet is not lost as a result of the outcome determined in step 504, process 500 continues to step 508 and the GUI of the game is modified to indicate progress in the resolution of the side bet. For example, referring to FIGS. 4A-4E, if a Streets of Gold side bet is being resolved, area 403 and area 407 may be updated to indicate (i) how many additional outcomes are still required to satisfy a win condition for the side bet; (ii) how many outcomes have been obtained thus far in the resolution of the side bet; and (iii) which "streets" have been hit thus far in the resolution of the side bet. If, on the other hand, it is a Number Run side bet that is being resolved, area 405 may be modified to indicate (i) the particular number of the grid that comprises the last obtained outcome; and (ii) how many additional outcomes are required to satisfy a win condition of the side bet.

Next, in step 510, the next outcome towards the resolution of the side bet is obtained (i.e., the outcome for the next consecutive spin of the roulette wheel in the primary roulette game is obtained, whether that outcome is just for one particular player of the players who have joined the side bet or for all players who have joined the side bet). The next outcome may be determined in the same or similar manner to that described with respect to step 504 and will thus not be repeated herein for purposes of brevity. Once the next outcome is obtained it is determined, in step 512, whether the side bet is lost as a result of the outcome determined in step 510. For example, if the side bet is a Streets of Gold side bet, it is determined whether the outcome is located within a street that has previously been hit in the resolution of the current side bet. In another example, if the side bet is a Number Run side bet, it is determined whether the outcome comprises a number that has previously been obtained as an outcome in the resolution of the current side bet. In some embodiments, a player may be participating in both a Streets of Gold and a Number Run side bet and thus step 512 may comprise determining whether either side bet is lost as a result of the outcome.

If it is determined that a side bet is lost as a result of the outcome determined in step 512, process 500 continues to step 518 and the GUI is modified to indicate the loss. Step 518 was described above. If, on the other hand, it is determined that a side bet was not lost as a result of the outcome determined in step 512, the process 500 continues to step 514. In step 514 it is determined whether a win condition of the side bet has been satisfied as a result of the outcome determined in step 512. For example, for a Streets of Gold side bet, it may be determined whether the required number of distinct streets have been hit. In another example, for a Number Run side bet, it may be determined whether a required number of distinct and non-repeating numbers have been obtained. If it is determined that a win condition for a side bet has not been satisfied, the process 500 loops back to step 510 (which was described above). If, on the other hand, it is determined that a win condition for a side bet has been satisfied as a result of the outcome determined in step 510, the process 500 continues to step 516. In step 516 the GUI of the game is modified to indicate the win of the side bet. For example, the appropriate window of the GUI may be updated with a message indicating the win (e.g., GUI 403 for a Streets of Gold side bet and GUI 405 for a Number Run side bet, if referring to the example embodiments of FIGS. 4A-4E). Such windows may also be modified to reflect the outcome obtained in step 510 (e.g., in a manner similar to that described with respect to step 508). Additionally, in some embodiments credits corresponding to a prize won by the player as a result of winning the side bet may be added to a credit meter balance of the player.

It should be noted that although the Streets of Gold and Number Run multi-spin bets have been described herein as comprising side bets, in other embodiments such bets may comprise the primary bets in a primary aspect of an electronic roulette game. Further, although the Streets of Gold and Number Run multi-spin bets have been described herein as comprising bets that a plurality of players can join, in other embodiments either or both of these multi-spin bets (whether embodied as primary game bets or side bets) may be available for individual players to participate in and not as multi-player bets. In such latter embodiments, an availability or resolution of the multi-spin bet may not be dependent in any manner on the participation of any player other than the single player who places the bet (and, similarly, a prize associated with such a multi-spin bet may not be dependent on the number of players or sum of wagers placed by multiple players).

In accordance with one embodiment, the electronic (e.g., online) roulette game described herein may be implemented via use of a physical wheel with an illuminated central hub. In accordance with some embodiments, the color of this hub could change indicating "one to go" or other status updates on the multi-spin bets to build anticipation and excitement.

Rules of Interpretation

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

The Title (set forth at the beginning of the first page of this disclosure) is not to be taken as limiting in any way as the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "and/or", when such term is used to modify a list of things or possibilities (such as an enumerated list of possibilities) means that any combination of one or more of the things or possibilities is intended, such that while in some embodiments any single one of the things or possibilities may be sufficient in other embodiments two or more (or even each of) the things or possibilities in the list may be preferred, unless expressly specified otherwise. Thus for example, a list of "a, b and/or c" means that any of the following interpretations would be appropriate: (i) each of "a", "b" and "c"; (ii) "a" and "b"; (iii) "a" and "c"; (iv) "b" and "c"; (v) only "a"; (vi) only "b"; and (vii) only "c."

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component or article is described herein, more than one device, component or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component or article is described herein (whether or not they cooperate), a single device, component or article may alternatively be used in place of the more than one device, component or article that is described. For example, a plurality of computer-based devices may be substituted with a single computer-based device. Accordingly, the various functionality that is described as being possessed by more than one device, component or article may alternatively be possessed by a single device, component or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, Digital Light Processing (DLP), rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as Standard Definition Television (SDTV), Enhanced Definition TV (EDTV), High Definition TV (HDTV), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure may refer to a "control system" or program. A control system or program, as that term is used herein, may be a computer processor coupled with an operating system, device drivers, and appropriate programs (collectively "software") with instructions to provide the functionality described for the control system. The software is stored in an associated memory device (sometimes referred to as a computer readable medium or an article of manufacture, which may be non-transitory in nature). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, Central Processing Unit (CPU) devices, computing devices, microcontrollers, digital signal processors, or like devices. Exemplary processors are the INTEL PENTIUM or AMD ATHLON processors.

The term "computer-readable medium" refers to any statutory medium that participates in providing data (e.g., instructions) that may be read by a computer, a processor or a like device. Such a medium may take many forms, including but not limited to non-volatile media, volatile media, and specific statutory types of transmission media. Non-volatile media include, for example, optical or magnetic disks and other persistent memory. Volatile media include DRAM, which typically constitutes the main memory. Statutory types of transmission media include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable memory", "article of manufacture" and/or "tangible media" specifically exclude signals, waves, and wave forms or other intangible or non-transitory media that may nevertheless be readable by a computer.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PRO- TOCOLS, ALGORITHMS, AND SOURCE CODE IN C, John Wiley & Sons, Inc. 2d ed., 1996, which is incorporated by reference in its entirety.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

What is claimed is:

1. An apparatus for facilitating an online game of roulette, comprising:

a game server cluster operable to communicate with a plurality of player gaming devices through a load balancer;

a cloud-based cache cluster operable to store real-time game state data for a plurality of online games and further operable to communicate with the game server cluster;

the game server cluster being operable to serve a plurality of distinct game instances for each of a plurality of different online games to any of the plurality of player devices by serving game outcomes to the plurality of player gaming devices by determining such outcomes using data received from a random number generator, wherein at least one game server of the game server cluster comprises a game controller comprising:

a processor;

a memory storing a program for interfacing with a web browser of a computing device of a player in order to output game data to the player via a graphical user interface of an online game of roulette, the program comprising instructions for the processor, wherein the processor is operable with the program to:

output in a first portion of the graphical user interface a representation of a roulette wheel;

output in a second portion of the graphical user interface an input mechanism via which the player can select a multi-spin wager, wherein a win condition of the multi-spin wager requires the player to obtain, over a plurality of consecutive spins of the roulette wheel, a predetermined minimum number of unique outcomes and wherein each unique outcome is independently determined such that it is not dependent on any previously determined outcome obtained for the multi-spin wager, wherein the player is not entitled to a payout for outcomes obtained for the plurality of consecutive spins until all of the minimum number of unique outcomes are obtained, and wherein a value of a parameter of the multi-spin wager that defines at least one outcome that, if obtained by the player during the multi-spin wager, will disqualify the player from winning the multi-spin wager (a disqualifying parameter value) is variable and determined dependent upon at least one outcome obtained by the player after the player places the multi-spin wager;

detect that the player has selected the multi-spin wager, thus initiating a game event comprising a plurality of spins of the online game of roulette;

modify the graphical user interfaces of any other players to whom the multi-spin wager was also output as available upon initiating the game event, to de-activate a wagering mechanic, such that the other players cannot place wagers on the game event until the game event is completed;

determine a first outcome of the plurality of independently-determined outcomes of the multi-spin wager, thereby determining the disqualifying parameter value;

determine at least one second outcome of the plurality of independently-determined outcomes;

determine whether the at least one second outcome comprises the disqualifying parameter value and, only if it does not, maintain the player's eligibility to win the multi-spin wager;

continue determining independently-determined outcomes for the multi-spin wager until an outcome that comprises the disqualifying parameter value is obtained or an end condition for the multi-spin wager has been satisfied;

determine, once the end condition for the multi-spin wager has been satisfied, the win result for the multi-spin wager by determining whether the independently-determined outcomes obtained by the player that do not comprise the disqualifying parameter value satisfy the win condition; and provide the payout to the player if the win result is a win of the payout.

2. The apparatus of claim 1, wherein the multi-spin wager is a side bet to a primary aspect of the online roulette game.

3. The apparatus of claim 1, wherein the multi-spin wager is made available to a plurality of players such that each player of the plurality of players may choose to join the multi-spin wager.

4. The apparatus of claim 3, wherein each player of the plurality of players receives a unique win determination for the multi-spin wager based on outcomes determined specifically for that player.

5. The apparatus of claim 3, wherein a prize for the multi-spin wager is determined based on a number of players who choose to join the multi-spin wager during a window of time in which it is available for joining.

6. The apparatus of claim 5, wherein the prize for the multi-spin wager being determined based on the number of players comprises a value of a parameter of the win condition for the prize being determined based on the number of players.

7. The apparatus of claim 1, wherein the processor being operable with the program to receive, via the input mechanism, a selection by the player of the multi-spin wager and an initiation of a win determination for the multi-spin wager comprises the processor being operable to receive the selection prior to the determination of the first outcome.

8. The apparatus of claim 1, wherein the processor being operable with the program to output, in the first portion of the graphical user interface and prior to indicating the win result for the multi-spin wager to the player, a representation of the roulette wheel spinning and the at least one ball landing on a second section of the roulette wheel that indicates the at least one second outcome, comprises the processor further being operable with the program to maintain an output of an indication of the first outcome while outputting the representation of the roulette wheel spinning and the ball landing on the second section of the roulette wheel that indicates the at least one second outcome.

9. The apparatus of claim 1, wherein unique outcomes comprise unique numbers that are different from one another.

10. The apparatus of claim 1, wherein unique outcomes comprise numbers that are represented in unique columns of a roulette game grid corresponding to the roulette wheel.

11. The apparatus of claim 1, wherein the processor is further operable with the program to determine, from a random number generator, a single output for the multi-spin wager, and determine each of the first outcome and the at least second outcome based on the single output.

12. The apparatus of claim 1, wherein the processor is further operable with the program to determine, from a first random number generator, a first output for use in determining the first outcome and at least one second output for use in determining the at least one second outcome.

13. A non-transitory computer-readable medium storing instructions for directing a processor of a game server to perform a method for facilitating an online game, wherein the game server is operable to output data via a graphical user interface viewable in a web browser of a remote player device, the game server being a component of a gaming system that comprises:

a game server cluster operable to communicate with a plurality of player gaming devices through a load balancer, the game server cluster including the game server;

a cloud-based cache cluster operable to store real-time game state data for a plurality of online games and further operable to communicate with the game server cluster;

the game server cluster being operable to serve a plurality of distinct game instances for each of a plurality of different online games to any of the plurality of player devices by serving game outcomes to the plurality of player gaming devices by determining such outcomes using data received from a random number generator, and wherein, the instructions causing the processor of the game server to:

output in a first portion of the graphical user interface a representation of a roulette wheel;

output in a second portion of the graphical user interface an input mechanism via which the player can select a multi-spin wager, wherein a win condition of the multi-spin wager requires the player to obtain, over a plurality of consecutive spins of the roulette wheel, a predetermined minimum number of unique outcomes and wherein each unique outcome is independently determined such that it is not dependent on any previously determined outcome obtained for the multi-spin wager, wherein the player is not entitled to a payout for outcomes obtained for the plurality of consecutive spins until all of the minimum number of unique outcomes are obtained, and wherein a value of a parameter of the multi-spin wager that defines at least one outcome that, if obtained by the player during the multi-spin wager, will disqualify the player from winning the multi-spin wager (a disqualifying parameter value) is variable and determined dependent upon at least one outcome obtained by the player after the player places the multi-spin wager;

detect that the player has selected the multi-spin wager, thus initiating a game event comprising a plurality of spins of the online game of roulette;

modify the graphical user interfaces of any other players to whom the multi-spin wager was also output as available upon initiating the game event, to de-activate a wagering mechanic, such that the other players cannot place wagers on the game event until the game event is completed;

determine a first outcome of the plurality of independently-determined outcomes of the multi-spin wager, thereby determining the disqualifying parameter value;

determine at least one second outcome of the plurality of independently-determined outcomes;

determine whether the at least one second outcome comprises the disqualifying parameter value and, only if it does not, maintain the player's eligibility to win the multi-spin wager;

continue determining independently-determined outcomes for the multi-spin wager until an outcome that comprises the disqualifying parameter value is obtained or an end condition for the multi-spin wager has been satisfied;

determine, once the end condition for the multi-spin wager has been satisfied, the win result for the multi-spin wager by determining whether the independently-determined outcomes obtained by the player that do not comprise the disqualifying parameter value satisfy the win condition; and provide the payout to the player if the win result is a win of the payout.

14. The non-transitory computer-readable medium of claim 13, wherein the multi-spin wager is a side bet to a primary aspect of the online roulette game.

15. The non-transitory computer-readable medium of claim 13, wherein the multi-spin wager is made available to a plurality of players such that each player of the plurality of players may choose to join the multi-spin wager.

16. The non-transitory computer-readable medium of claim 15, wherein each player of the plurality of player receives a unique win determination for the multi-spin wager based on outcomes determines specifically for that player.

17. The non-transitory computer-readable medium of claim 15, wherein a prize for the multi-spin wager is determined based on a number of players who choose to join the multi-spin wager during a window of time in which it is available for joining.

18. The non-transitory computer-readable medium of claim 17, wherein the prize for the multi-spin wager being determined based on the number of players comprises a value of a parameter of the win condition for the prize being determined based on the number of players.

19. The non-transitory computer-readable medium of claim 13, wherein unique outcomes comprise unique numbers that are different from one another.

20. The non-transitory computer-readable medium of claim 13, wherein unique outcomes comprise numbers that are represented in unique columns of a roulette game grid corresponding to the roulette wheel.

* * * * *